United States Patent [19]

Naito et al.

[11] Patent Number: 4,478,927

[45] **Date of Patent: * Oct. 23, 1984**

[54] HEAT-DEVELOPABLE COLOR PHOTOGRAPHIC MATERIALS

[75] Inventors: Hideki Naito; Hiroshi Hara; Toshiaki Aono; Kozo Sato, all of Kanagawa, Japan

[73] Assignee: Fuji Photo Film Company Limited, Kanawawa, Japan

[ * ] Notice: The portion of the term of this patent subsequent to Jul. 31, 2001 has been disclaimed.

[21] Appl. No.: 384,118

[22] Filed: Jun. 1, 1982

[30] Foreign Application Priority Data

Jun. 1, 1981 [JP] Japan ..... 56-84164

[51] Int. Cl.[3] ..... G03C 5/54; G03C 1/10; G03C 1/40

[52] U.S. Cl. ..... 430/203; 430/223

[58] Field of Search ..... 430/203, 223, 619, 351, 430/213, 559, 617, 618

[56] References Cited

U.S. PATENT DOCUMENTS 3,761,270 9/1973 de Mauriac et al. ..... 430/351
4,021,240 5/1977 Cerquone et al. ..... 430/203
4,022,617 5/1977 McGuckin ..... 430/203

FOREIGN PATENT DOCUMENTS 2058383 4/1981 United Kingdom ..... 430/617

OTHER PUBLICATIONS

"Positive Images in Photothermographic Materials" Hohrt *Research Disclosure* No. 16408, 12/1977, pp. 15 & 16.

*Primary Examiner*—Richard L. Schilling
*Attorney, Agent, or Firm*—Sughrue, Mion, Zinn, Macpeak and Seas

[57] ABSTRACT

A heat-developable color photographic material is disclosed. The material is comprised of a support having thereon a layer containing at least a light-sensitive silver halide and the photographic material containing an organic silver salt, a binder, a dye releasing activator and a dye releasing redox compound which releases a diffusible dye. The improvement comprises a support capable of receiving a released dye or a support having thereon a layer composed of an organic high molecular weight compound capable of receiving a released dye. The heat-developable color photographic material can easily provide a clear and stable color image by image-wise exposure to light and heat development procedure. A method of forming a color image using the heat-developable color photographic material is also disclosed.

26 Claims, No Drawings

HEAT-DEVELOPABLE COLOR PHOTOGRAPHIC MATERIALS

FIELD OF THE INVENTION

The present invention relates to a heat-developable color photographic material which forms a color image by heat development. Particularly, the present invention relates to a novel heat-developable color photographic material containing a dye releasing redox compound which releases a diffusible dye by heat development.

More particularly, the present invention relates to a novel heat-developable color photographic material which forms a color image by directly transferring the dye released by heat development to a support thereof.

BACKGROUND OF THE INVENTION

In the past, photographic processes using silver halide have been most widely used because they are excellent in photographic properties such as sensitivity or control of gradation as compared with other photographic processes, such as, an electrophotographic process or a diazo photographic process. In recent years, with respect to image formation processes for photographic materials using silver halide, many techniques capable of obtaining images with ease and rapidly have been developed by changing the conventional wet process using a developing solution into a dry process such as a process using heat.

Heat-developable photographic materials are known in the field of these techniques. Heat-developable photographic materials and processes therefor have been described in U.S. Pat. Nos. 3,152,904, 3,301,678, 3,392,020 and 3,457,075, British Pat. Nos. 1,131,108 and 1,167,777, and *Research Disclosure*, No. 17029, pages 9 to 15 (June 1978).

Many different processes for obtaining color images have been proposed. With respect to processes for forming color images by the reaction of an oxidation product of a developing agent with a couplers, the following processes have been proposed: (1) using a p-phenylenediamine type reducing agent and a phenolic coupler or an active methylene coupler as described in U.S. Pat. No. 3,531,286; (2) using a p-aminophenol type reducing agent as described in U.S. Pat. No. 3,761,270; (3) using a sulfonamidophenol type reducing agent as described in Belgium Pat. No. 802,519 and *Research Disclosure*, pages 31 and 32 (September 1975); and (4) using the combination of a sulfonamidophenol type reducing agent and a 4-equivalent coupler as described in U.S. Pat. No. 4,021,240. These processes, however, are disadvantageous in that turbid color images are formed, because a reduced silver image and a color image are simultaneously formed on the exposed area after heat development. In order to eliminate these disadvantages, there have been proposed a process which comprises removing a silver image by liquid processing as well as a process which comprises transferring only the dye to another layer, for example, a sheet having an image receiving layer. However, the latter process is not desirable because it is not easy to transfer only the dye as distinguishable from unreacted substances.

Another process which comprises introducing a nitrogen-containing heterocyclic group into a dye, forming a silver salt and releasing a dye by heat development has been described in *Research Disclosure*, No. 16966, pages 54 to 58 (May 1978). According to this process, clear images can not be obtained, because it is difficult to control the release of dyes from unexposed areas, and thus it is not a practical process.

Processes for forming a positive color image by a thermal silver dye bleach process, with useful dyes and methods for bleaching have been described, for example, in *Research Disclosure*, No. 14433, pages 30 to 32 (April 1976), ibid., No. 15227, pages 14 to 15 (December 1976) and U.S. Pat. No. 4,235,957. However, this process requires an additional step and an additional material in order to accelerate the bleaching of dyes, for example, by heating with a superposed activating agent sheet. Furthermore, it is not desirable because the resulting color images are gradually reduced and bleached by coexisting free silver during preservation for a long period of time.

A process for forming a color image utilizing a leuco dye has been described, for example, in U.S. Pat. Nos. 3,985,565 and 4,022,617. However, this process is not desirable because it is difficult to stably incorporate the leuco dye in the photographic material and coloration gradually occurs during preservation.

It is also known in the field of textiles to dye polyester with an azo dye. Although processes for application of the dyeing of polyester to a photographic field have been proposed, sufficient results have not been obtained. For example, a process for using a polyester film as an image receiving layer is described in U.S. Pat. No. 4,235,957. However, according to this process, the diffusion of dyes to a polyester film and the bleaching of dyes occurs simultaneously in order to form a positive image by a silver dye bleach process, and thus it is difficult to form an image having a good S/N value.

A process for transferring a dye formed upon the coupling reaction of a hydrazone developing agent with a coupler into a polyester support is described in the example of British Pat. No. 2,056,103. However, this process does not provide a sufficient image since a dye forming efficiency of the coupling reaction is low and also a transferring property to the support is poor.

SUMMARY OF THE INVENTION

The present invention provides a novel process for forming a color image using a heat-developable color photographic material eliminating the drawbacks of known materials.

Therefore, an object of the present invention is to provide a process for easily forming a color image using a dye releasing redox compound.

Another object of the present invention is to provide a process for obtaining a clear color image by a simple procedure.

Still another object of the present invention is to provide a process for obtaining a color image which is stable for a long period of time.

These and other objects of the present invention will become more apparent from the following detailed description and examples.

These objects of the present invention are attained by diffusion transfer of a dye released in a heat-developable color photographic material comprising a support having thereon a layer containing at least a light-sensitive silver halide, an organic silver salt, a dye releasing activator, a binder and a dye releasing redox compound which is capable of reducing the organic silver salt and is capable of releasing a diffusible dye upon heat development to the support to form a color image.

According to the present invention, a heat-developable color photographic material is comprised of a support having thereon a layer containing at least a light-sensitive silver halide, an organic silver salt, a binder, a dye releasing activator and a dye releasing redox compound which releases a diffusible dye, the improvement which comprises a support being capable of receiving a released dye or the support having thereon a layer composed of an organic high molecular weight compound which is capable of receiving a released dye.

DETAILED DESCRIPTION OF THE INVENTION

The heat-developable color photographic material of the present invention can simultaneously provide a silver image having a negative-positive relationship to the original and a diffusible dye on the part corresponding to the silver image by only carrying out heat development after imagewise exposure to light. That is, when the heat-developable color photographic material of the present invention is imagewise exposed to light and developed by heating, an oxidation-reduction reaction occurs between exposed light-sensitive silver halide and/or an organic silver salt and a dye releasing redox compound in an area where said exposed light-sensitive silver halide exists to form a silver image in the exposed area. In this step, the dye releasing redox compound is oxidized by the organic silver salt to form an oxidized product. This oxidized product is cleaved in the presence of the dye releasing activator and as a result a diffusible dye is released. The diffusible dye diffuses through a binder and reaches a support. In consequence, a negative dye image is formed in the support.

According to this process, an unreacted dye releasing redox compound does not diffuse into the support mainly due to a bulky molecule thereof and only the released dye diffuses into the support. Therefore, a very clear image can be obtained which is an advantage of the present invention. Further, since a dye is previously incorporated into a dye releasing redox compound in this process, the conditions for a coupling reaction or bleaching during heat development are not required and thus, any dye may be used which is readily diffusible into the support which is another advantage of the present invention.

The light-sensitive silver halide used in the present invention can be employed in a range from 0.005 mols to 5 mols and, preferably, from 0.005 mols to 1.0 mol per mol of the organic silver salt.

Examples of silver halide include silver chloride, silver chlorobromide, silver chloroiodide, silver bromide, silver iodobromide, silver chloroiodobromide and silver iodide.

The particle size of the silver halide used is from 0.001 μm to 2 μm and, preferably, from 0.001 μm to 1 μm.

The silver halide used in the present invention may be employed as is. However, it may be chemically sensitized with a chemical sensitizing agent such as a compound containing sulfur, selenium or tellurium, etc. or a compound containing gold, platinum, palladium, rhodium or iridium, etc., a reducing agent such as a tin halide, etc. or a combination thereof. The details of these procedures are described in T. H. James, *The Theory of the Photographic Process*, Fourth Edition, Chapter 5, pages 149 to 169.

The organic silver salt which can be used in the present invention is a silver salt which is comparatively stable to light and which forms a silver image by reacting with the above described dye releasing redox compound or an auxiliary developing agent which is coexisting with the dye releasing redox compound, if desired, when it is heated to a temperature of above 80° C. and, preferably, above 100° C. in the presence of exposed silver halide.

Examples of such organic silver salt include the following compounds.

A silver salt of an organic compound having a carboxy group. Preferred examples thereof include a silver salt of an aliphatic carboxylic acid and a silver salt of an aromatic carboxylic acid.

Preferred examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linolate, silver adipate, silver sebacate, silver succinate, silver acetate, silver butyrate and silver camphorate, etc. Silver salts which are substituted with a halogen atom or a hydroxyl group can also be effectively used.

Preferred examples of the silver salts of aromatic carboxylic acid and other carboxyl group-containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione or the like as described in U.S. Pat. No. 3,785,830, and a silver salt of an aliphatic carboxylic acid containing a thioether group as described in U.S. Pat. No. 3,330,663, etc.

In addition, a silver salt of a compound containing mercapto group or a thione group and a derivative thereof can be used.

Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-mercaptobenzothiazole, a silver salt of 2-(s-ethylglycolamido)-benzothiazole, a silver salt of thioglycolic acid such as a silver salt of a s-alkyl thioglycolic acid (wherein the alkyl group has from 12 to 22 carbon atoms) as described in Japanese Patent Application (OPI) No. 28221/73 (the term "OPI" as used herein refers to a "published unexamined Japanese Patent Application"), a silver salt of dithiocarboxylic acid such as a silver salt of dithioacetic acid, a silver salt of thioamide, a silver salt of 5-carboxyl-1-methyl-2-phenyl-4-thiopyridine, a silver salt of mercaptotriazine, a silver salt of 2-mercaptobenzoxazole, a silver salt of mercaptooxoadiazole, a silver salt as described in U.S. Pat. No. 4,123,274, for example, a silver salt of 1,2,4-mercaptotriazole derivative such as a silver salt of 3-amino-5-benzylthio-1,2,4-triazole, a silver salt of thione compound such as a silver salt of 3-(2-carboxyethyl)-4-methyl-4-thiazoline-2-thione as described in U.S. Pat. No. 3,301,678, and the like.

Furthermore, a silver salt of a compound containing an imino group can be used. Preferred examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Preferred examples include a silver salt of carboxylic acid derivatives or N-containing heterocyclic compounds.

The mechanism of the heat development process under heating in the present invention is not entirely clear, but it is believed to be as follows.

When the photographic material is exposed to light, a latent image is formed in a light-sensitive silver halide. This phenomenon is described in T. H. James, *The Theory of the Photographic Process*, Third Edition, pages 105 to 148 incorporated herein by reference.

When the photographic material is heated, the reducing agent, that is, the dye releasing redox compound in the case of the present invention, reduces the organic silver salt or both of the silver halide and the organic silver salt in the presence of the latent image signal nuclei as a catalyst with the aid of an alkali agent released by heating to form silver or metal, while it is oxidized itself. The oxidized dye releasing redox compound is attacked by a nucleophilic reagent (which may be an alkali agent) to release a dye.

The silver halide and the organic silver salt which form a starting point of development should be present in the same layer, adjacent layers or layers adjacent each other through an intermediate layer having the thickness of less than 1$\mu$.

For this purpose, it is desired that the silver halide and the organic silver salt are present in the same layer.

The silver halide and the organic silver salt which are separately formed in a binder can be mixed prior to use to prepare a coating solution, but it is also effective to blend both of them in a ball mill for a long period of time. Further, it is effective to use a process which comprises adding a halogen-containing compound in the organic silver salt prepared to partially convert the silver of the organic silver salt to silver halide.

Methods of preparing these silver halide and organic silver salts and manners of blending them are described in *Research Disclosure*, No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt employed in the present invention is in a total from 50 mg to 10 g/m$^2$ calculated as an amount of silver.

The dye releasing redox compound which releases a diffusible dye which can be used in the present invention is represented by the following general formula:

$$R—SO_2—D \qquad (I)$$

wherein R represents a reducing group capable of being oxidized by the organic silver salt; and D represents a dye portion for forming an image.

It is preferred that the reducing group in the dye releasing redox compound of the formula R—$SO_2$—D has an oxidation potential to a saturated calomel electrode of 1.2 V or less measuring the polarographic half wave potential using acetonitrile as a solvent and sodium perchlorate as a supporting electrolyte. Preferred examples of the reducing group are represented by the following formuae (II) to (IX).

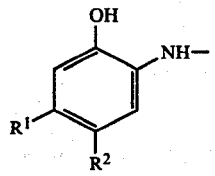
(II)

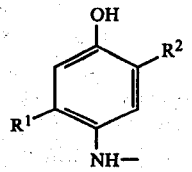
(III)

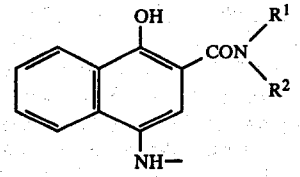
(IV)

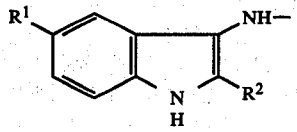
(V)

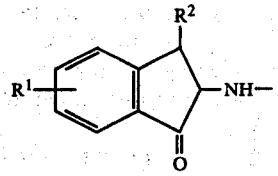
(VI)

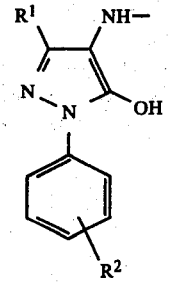
(VII)

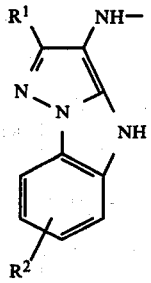
(VIII)

-continued (IX)

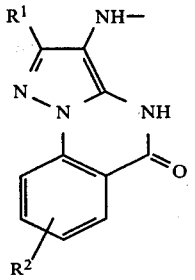

wherein $R^1$ and $R^2$, which may be the same or different, each represents hydrogen or a substituent selected from the group consisting of an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group and an N-substituted sulfamoyl group, and these substituents may be further substituted with a hydroxyl group, a carboxyl group, a sulfo group, a cyano group, a sulfamoyl group, a carbamoyl group, an acylamino group, an alkylsulfonylamino group, an arylsulfonylamino group, a ureido group or a substituted ureido group. The total number of the carbon atoms of substituents represented by $R^1$ and $R^2$ is preferably from 4 to 15.

Characteristics required for the reducing group represented by R are as follows.

(1) It is rapidly oxidized by the organic silver salt to effectively release a diffusible dye for image formation upon the action of the dye releasing activator.

(2) It is necessary that the dye releasing redox compound is immobilized in a binder. For this purpose, the reducing group represented by R has a hydrophilic group when the compound is used in a hydrophobic binder or has an oil-soluble group when the compound is used in a hydrophilic binder.

(3) It has excellent stability to heat and to the dye releasing activator and does not release the image forming dye until it is oxidized.

(4) It is easily synthesized.

Specific examples of the preferred reducing group represented by R are set forth below, but the present invention is not to be construed as being limited thereto.

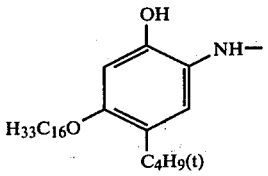

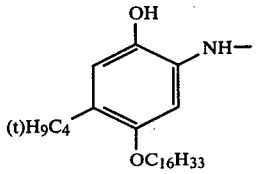

-continued

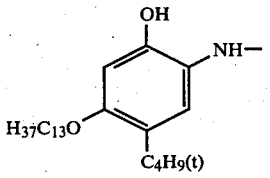

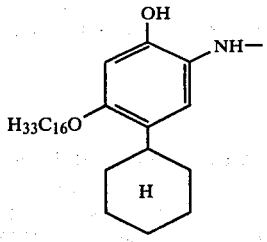

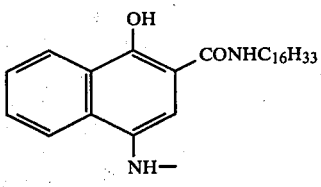

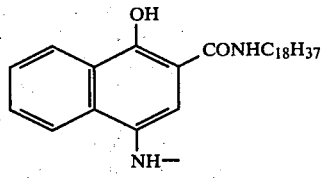

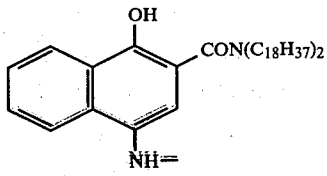

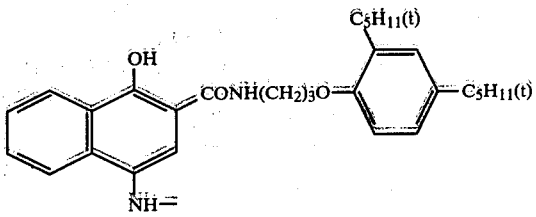

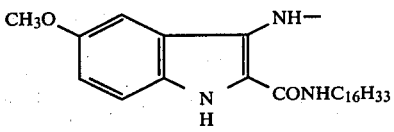

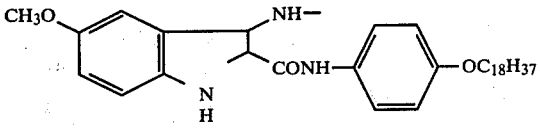

-continued

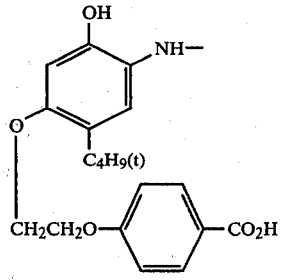

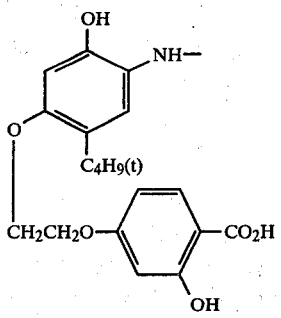

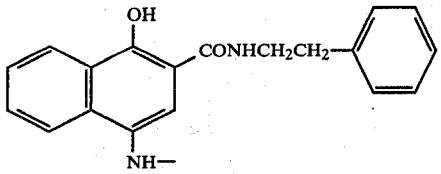

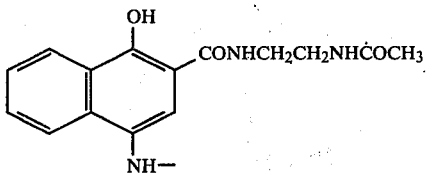

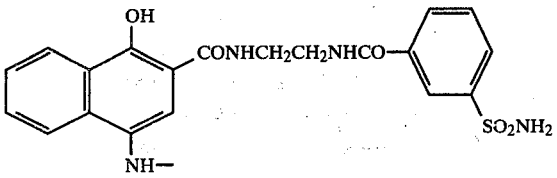

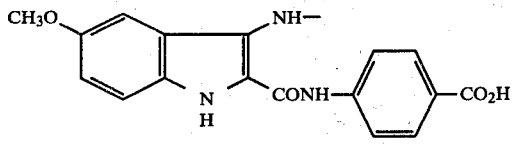

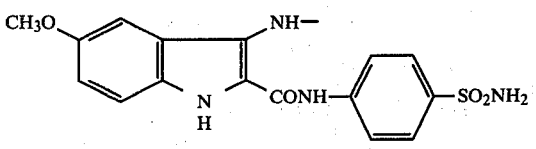

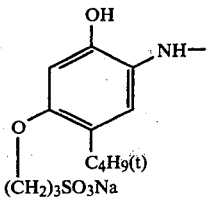

-continued

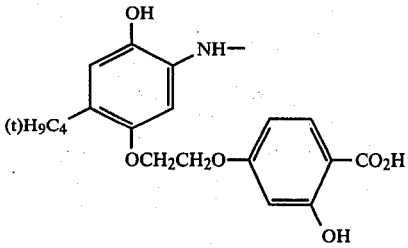

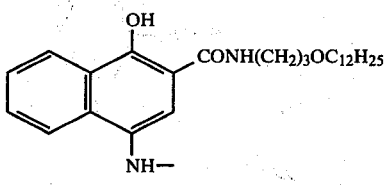

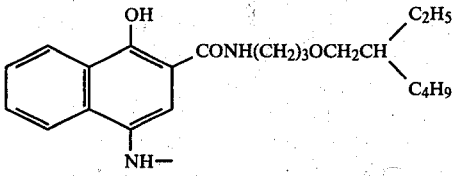

In the above formulae, NH— represents a bond to the connecting group represented by the formula $SO_2$ which is bonded to the dye portion.

Examples of dyes which can be used for image forming dyes include an azo dye, an azomethine dye, an anthraquinone dye, a naphthoquinone dye, a styryl dye, a quinophthalone dye and a phthalocyanine dye, etc. Preferred examples of dyes which can be used for image forming dyes include a water insoluble dye which does not contain a carboxyl group or a sulfo group. More preferred examples of the dyes are set forth below and are classified by hue.

Yellow:

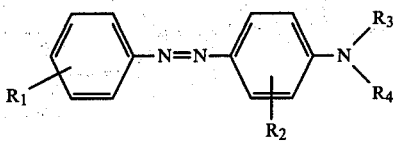

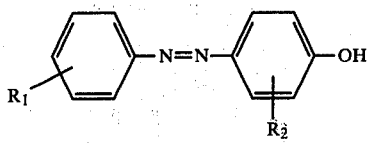

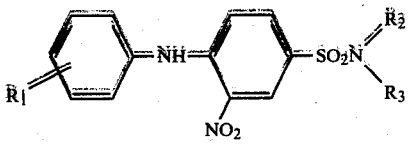

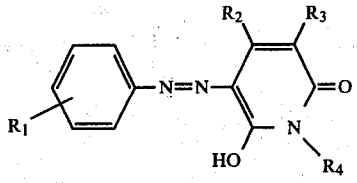

-continued
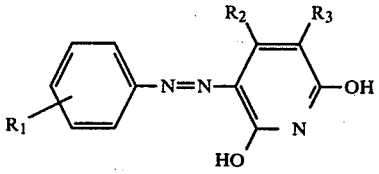
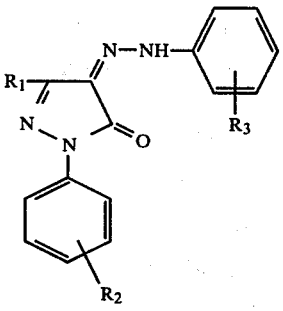
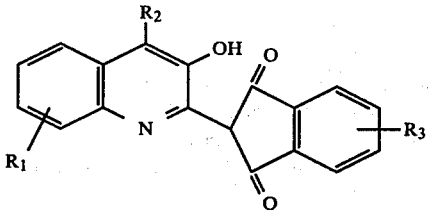
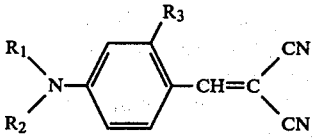
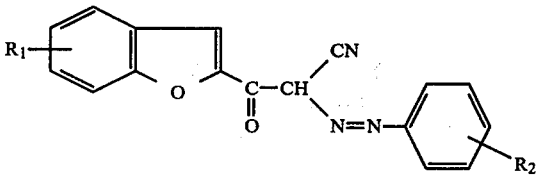
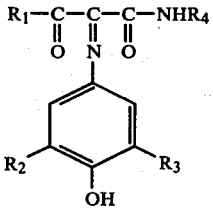
Magenta:
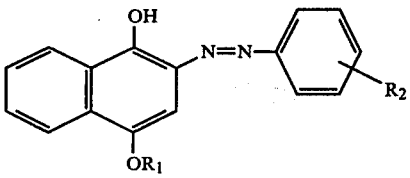
-continued
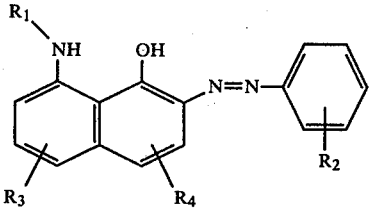
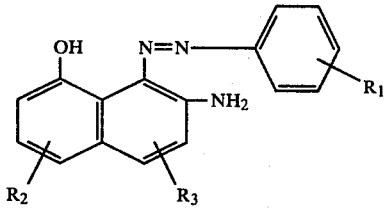
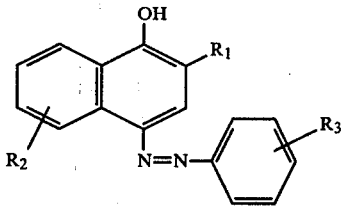
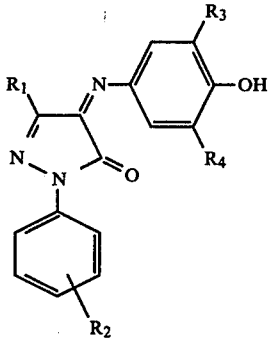
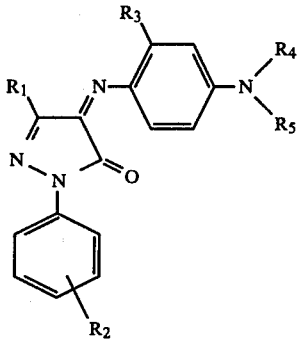
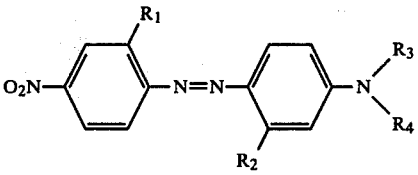
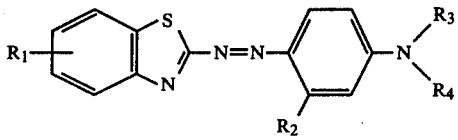

-continued
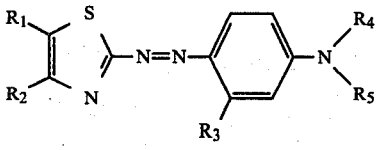
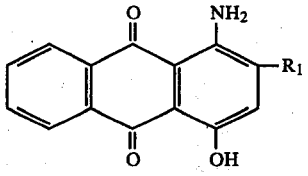
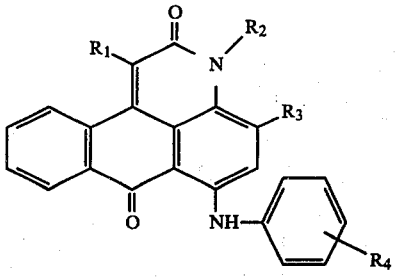
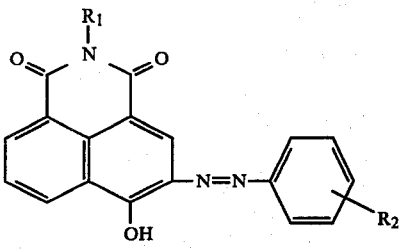
Cyan:
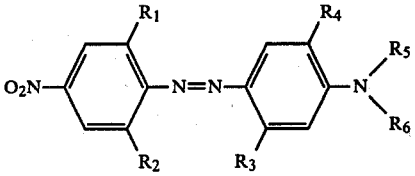
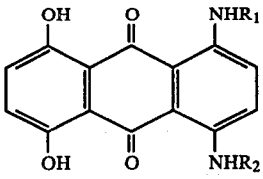
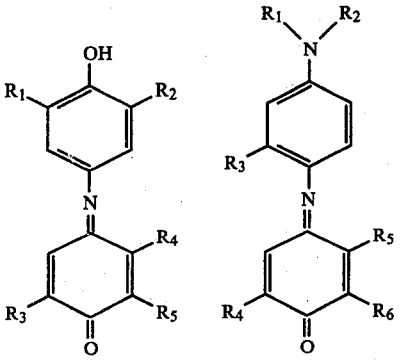
-continued
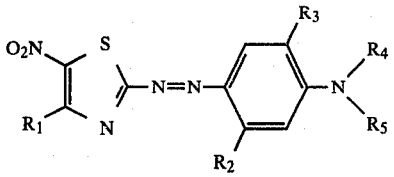
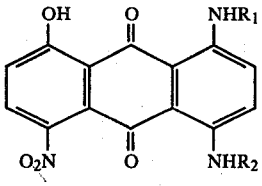
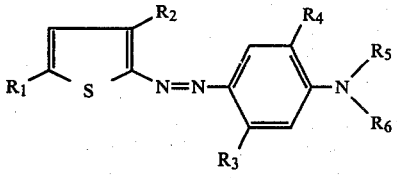
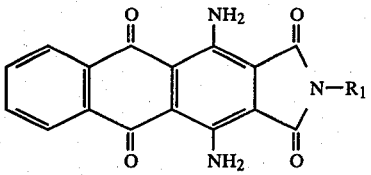
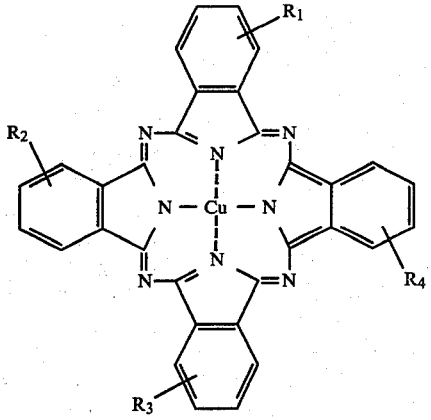
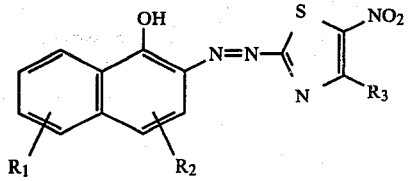
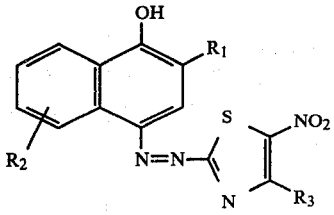

-continued

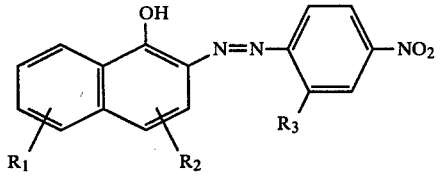

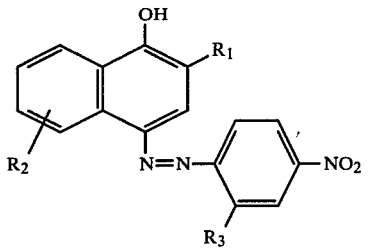

In the above formulae, $R_1$ to $R_6$, which may be the same or different, each represents hydrogen or a substituent selected from the group consisting of an alkyl group, a cycloalkyl group, an aralkyl group, an alkoxy group, an aryloxy group, an aryl group, an acylamino group, an acyl group, an cyano group, a hydroxy group, an alkylsulfonylamino group, an arylsulfonylamino group, an alkylsulfonyl group, a hydroxyalkyl group, a cyanoalkyl group, an alkoxycarbonylalkyl group, an alkoxyalkyl group, an aryloxyalkyl group, a nitro group, a halogen, a sulfamoyl group, an N-substituted sulfamoyl group, a carbamoyl group, an N-substituted carbamoyl group, an acyloxyalkyl group, an amino group, a substituted amino group, an alkylthio group and an arylthio group. It is preferred that the number of the carbon atoms of substituent represented by $R_1$ to $R_6$ is from 1 to 8, and the total number of the carbon atoms of substituents represented by $R_1$ to $R_6$ is from 1 to 18, or the substituents of $R_1$ to $R_6$ each represents hydrogen.

Characteristics required for the image forming dyes are as follows.

(1) It does not have a hydrophilic group such as a carboxylic acid group or a sulfonic acid group and can effectively diffuse by heating into a support acting as an image receiving layer.

(2) It has a hue suitable for color reproduction hue.

(3) It has a large molecular extinction coefficient.

(4) It is stable to light, heat and other additives in the system, such as the dye releasing activator.

(5) It is easily synthesized.

Specific examples of the preferred image forming dyes which satisfy the above described requirements are set forth below, but the present invention is not to be construed as being limited thereto.

Yellow

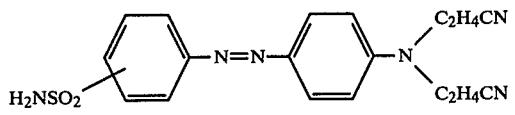

-continued

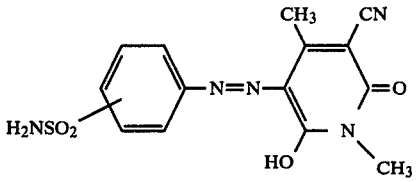

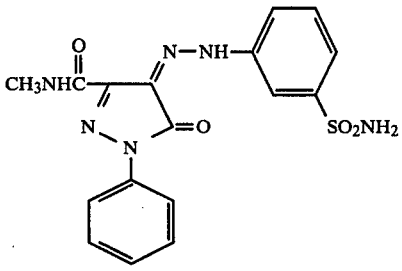

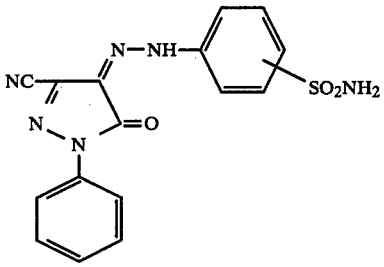

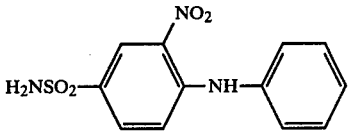

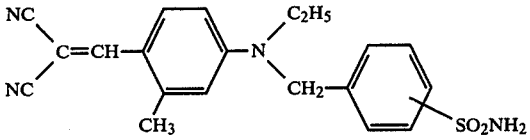

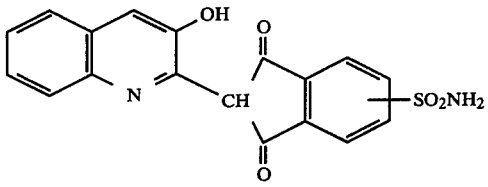

Magenta

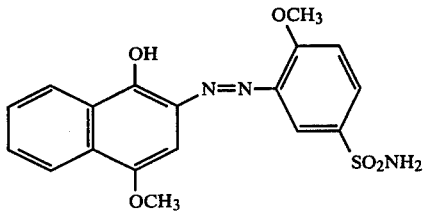

-continued
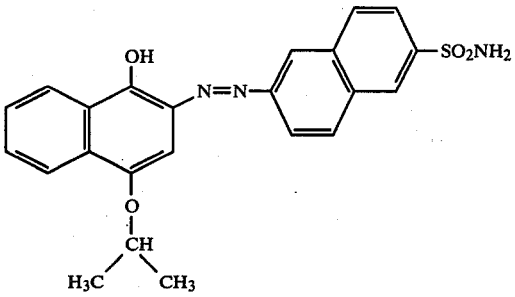
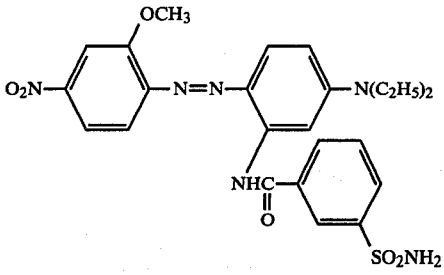
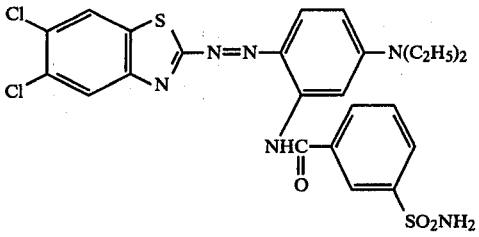
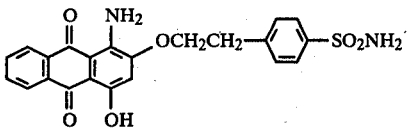
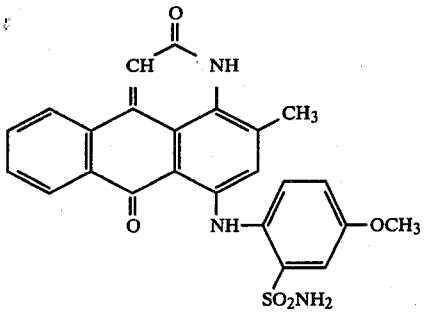
-continued
Cyan
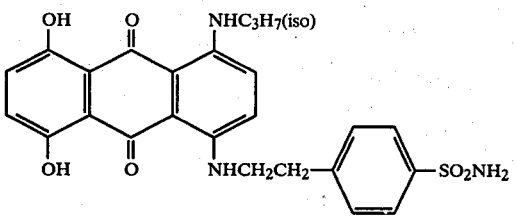
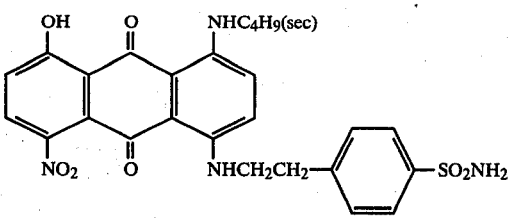
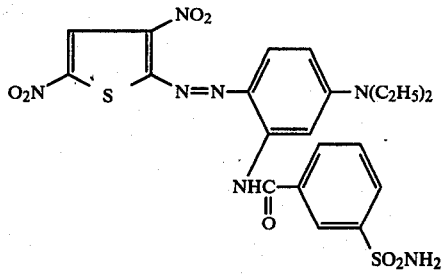
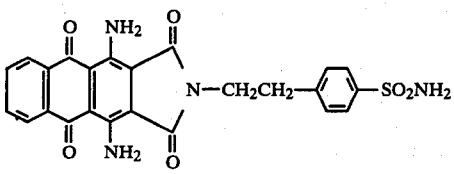
In the above formulae, the group of the formula $-SO_2NH_2$ represents a connecting portion with the reducing group represented by R.
Specific examples of the preferred dye releasing redox compounds are set forth below, but the present invention is not to be construed as being limited thereto.
[1]
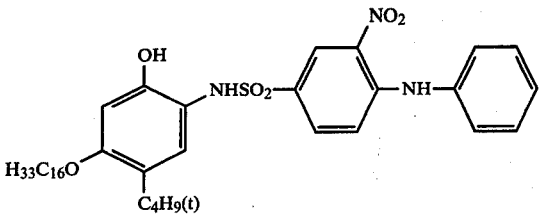

-continued
[2]
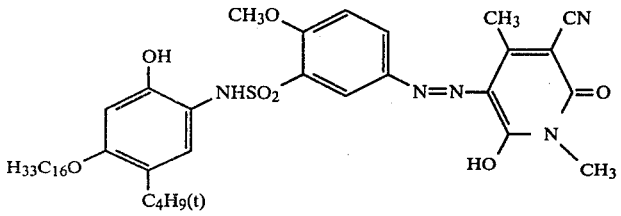
[3]
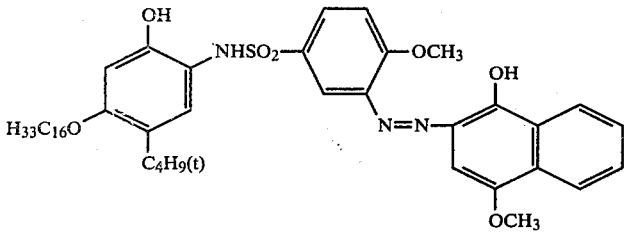
[4]
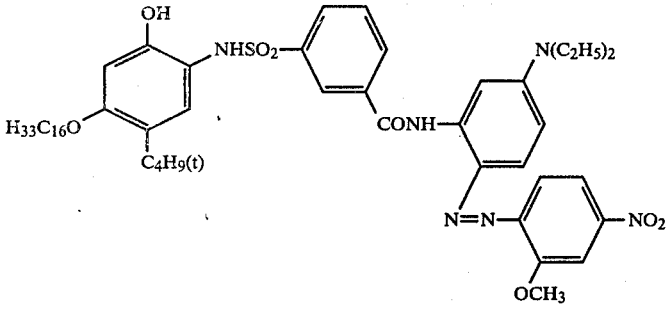
[5]
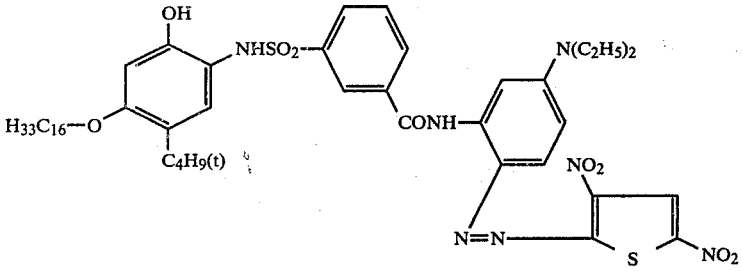
[6]
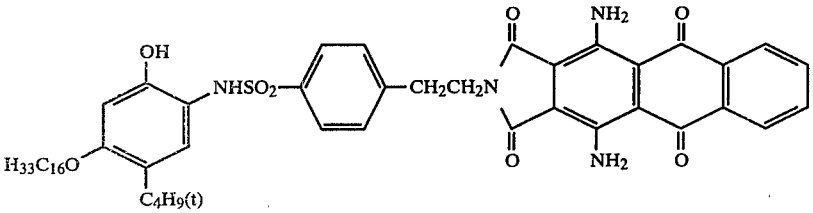
[7]
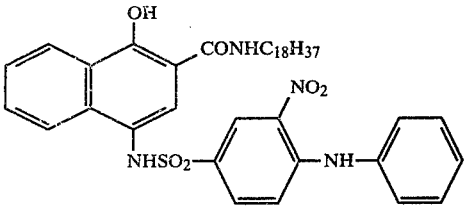

-continued
[8]
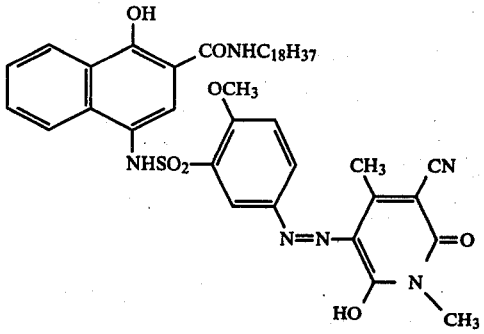
[9]
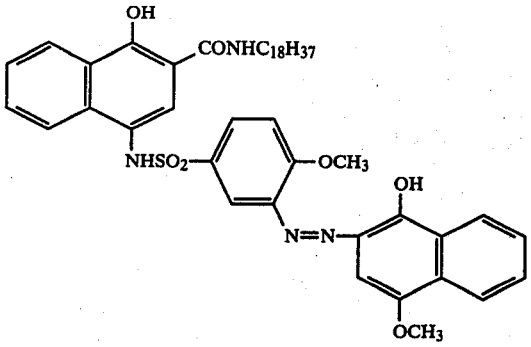
[10]
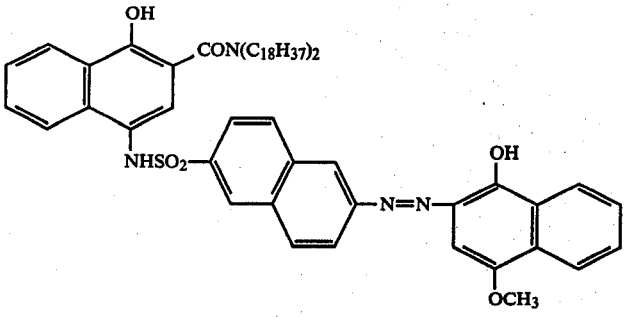
[11]
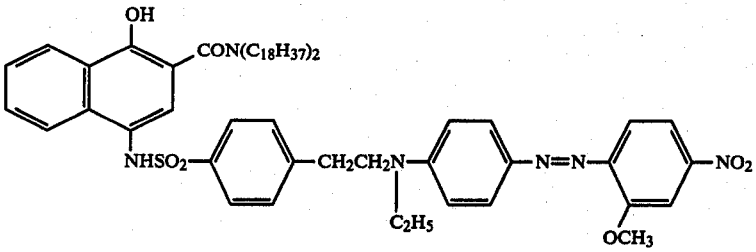
[12]
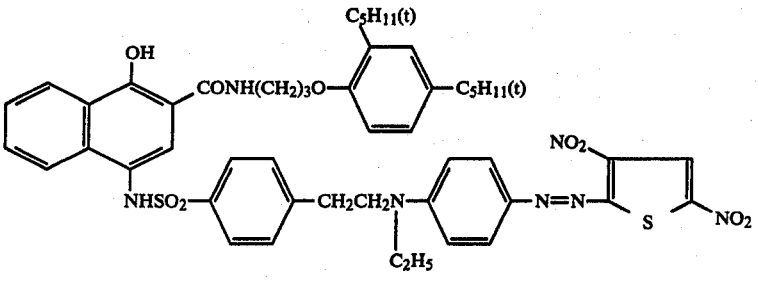

-continued
[13]
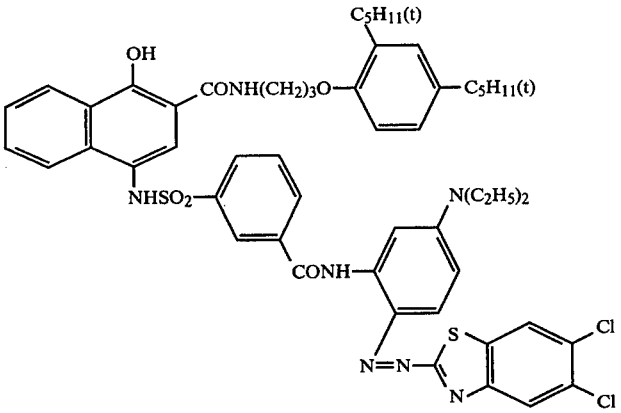
[14]
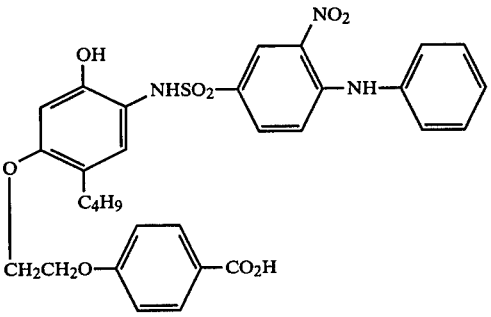
[15]
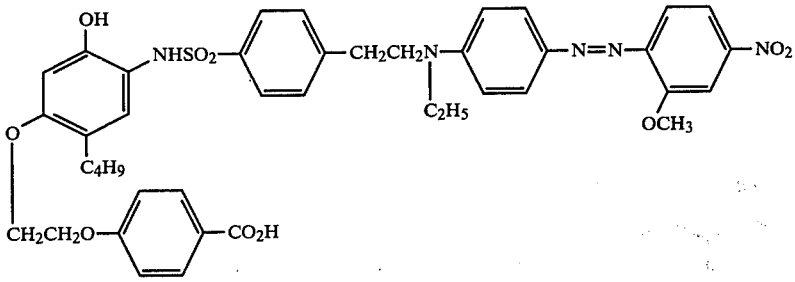
[16]
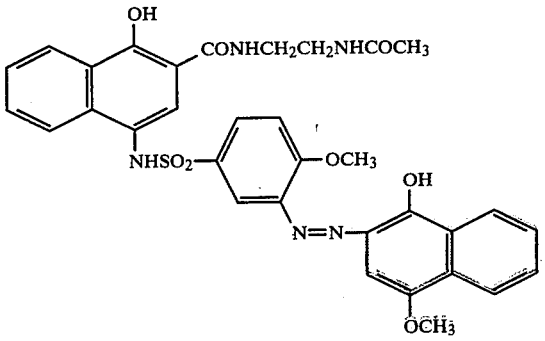
[17]
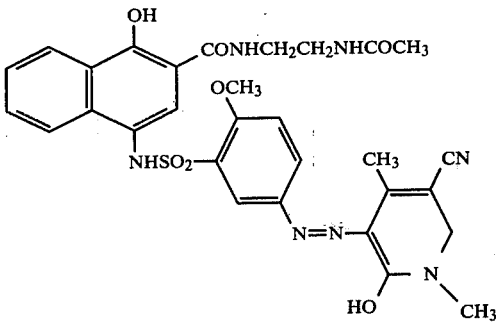

-continued

[18]

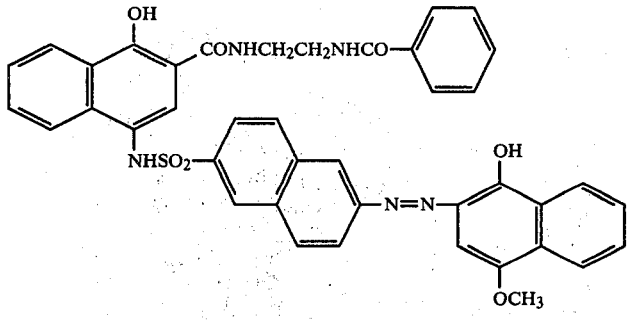

[19]

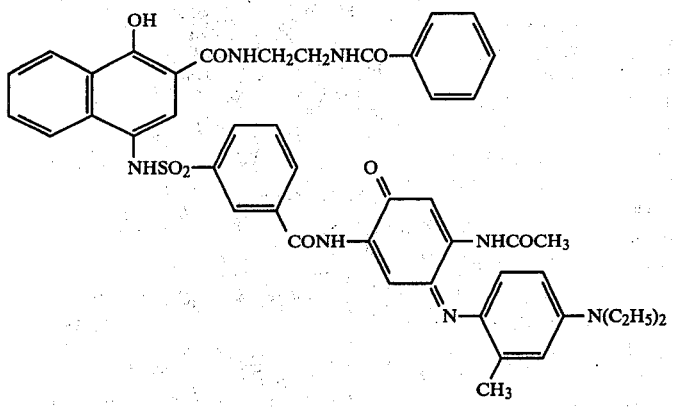

[20]

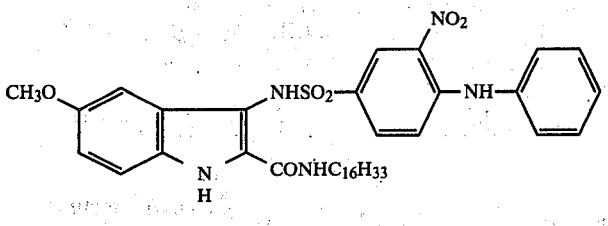

[21]

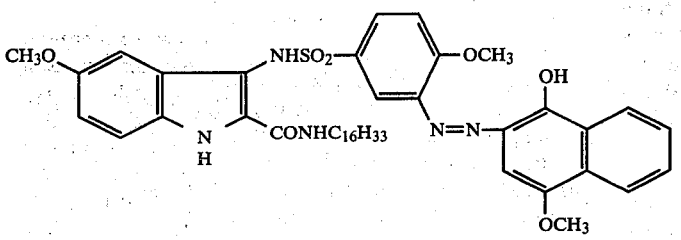

The synthesis methods of the dye releasing redox compounds according to the present invention are described below.

In general, the dye releasing redox compounds can be obtained by condensing an amino group of the reducing group represented by R with a chlorosulfonyl group of the image forming dye portion.

The amino group of the reducing group of R can be introduced by reduction of a nitro group, a nitroso group or an azo group or ring-opening reaction of a benzoxazole ring depending on the kind of the reducing group and can be used as a free base or can be used as a salt of an inorganic acid. On the other hand, the chlorosulfonyl group of the image forming dye portion is derived by converting the corresponding sulfonic acid or salt thereof into acid chloride using a chlorinating agent such as phosphorus oxychloride, phosphorus pentachloride or thionyl chloride, etc. according to a conventional method.

The condensation reaction of the reducing group of R with the image forming dye portion of D can be generally carried out in an aprotic polar solvent such as dimethylformamide, dimethylacetamide, dimethylsulfoxide, N-methylpyrrolidone or acetonitrile, etc. in the presence of an organic base such as pyridine, picoline, lutidine, triethylamine or diisopropylethylamine, etc. at a temperature ranging from 0° C. to 50° C. and, by which the desired dye releasing redox compound can generally be obtained in an extremely high yield. Synthesiss examples of the dye releasing redox compounds are set forth below.

1. SYNTHESIS OF DYE RELEASING REDOX COMPOUND (1)

1-a: Synthesis of 2-amino-4-tert-butyl-5-hexadecyloxyphenol hydrochloride [1-a]

37.3 g (0.1 mol) of 2-methyl-6-hexadecyloxybenzoxazole obtained by the reaction of 2-methyl-6-hydroxybenzoxazole with hexadecyl bromide was added to a mixture composed of 30 ml of hydrochloric acid and 300 ml of ethanol and the mixture was stirred at a temperature range between 40° C. and 50° C. for 1 hour. After cooling, the crystals deposited were collected by filtration and washed with ethanol to obtain 35.8 g of 2-acetylamino-5-hexadecyloxyphenol.

A mixture composed of 19.6 g (0.05 mol) of 2-acetylamino-5-hexadecyloxyphenol, 20 g of tertbutyl chloride, 6 g of anhydrous zinc chloride and 60 ml of 1,1,1-trichloroethane was stirred with heating at a temperature range between 70° C. and 75° C. for 5 hours. After cooling, the excess amount of tert-butyl chloride and the solvent were removed under reduced pressure. The residue was washed with water and recrystallized from acetonitrile to obtain 18.2 g of 2-acetylamino-4-tert-butyl-5-hexadecyloxyphenol.

22.4 g (0.05 mol) of 2-acetylamino-4-tert-butyl-5-hexadecyloxyphenol was added to a mixture composed of 50 ml of hydrochloric acid and 150 ml of ethanol and the mixture was stirred with heating at a temperature of 80° C. for 2 hours. after cooling, the crystals deposited were collected by filtration washed with ethanol to obtain 17.9 g of 2-amino-4-tert-butyl-5-hexadecyloxyphenol hydrochloride [1-a].

1-b: Synthesiss of 2-nitrodiphenylamine-4-sulfonyl chloride [1-b]

A mixture composed of 26 g (0.1 mol) of sodium 4-chloro-3-nitrobenzene sulfonate and 93 g of aniline was heated at a temperature of 100° C. for 3 hours. After removing the excess amount of aniline under reduced pressure, to the residue was added cool diluted hydrochloric acid and the resulting yellow crystals were collected by filtration. 29.4 g (0.1 mol) of 2-nitrodiphenylamine-4-sulfonic acid thus obtained was added to a mixture composed of 100 ml of acetonitrile and 50 ml of dimethylacetamide and then 50 ml of phosphorus oxychloride was added dropwise to the mixture at a temperature range between 20° C. and 25° C. After stirring at room temperature for 2 hours, the reaction solution was poured into ice water and the resulting yellow precipitate was collected by filtration and washed with water to obtain 29.2 g of 2-nitrodiphenylamine-4-sulfonyl chloride [1-b].

1-c: Synthesis of dye releasing redox compound (1)

4.26 g (0.01 mol) of Compound [1-a] was dissolved in a mixture composed of 20 ml of dimethylacetamide and 5 ml of pyridine and to the solution was gradually added 3.13 g (0.01 mol) of Compound [1-b] under cooling with ice. After stirring at room temperature for 30 minutes, the reaction solution was poured into cool diluted hydrochloric acid and the resulting yellow precipitate was collected by filtration. Upon recrystallization from acetonitrile a refined product was obtained.

2. SYNTHESIS OF DYE RELEASING REDOX COMPOUND (2)

2-b: Synthesis of 5-(3-chlorosulfonyl-4-methoxyphenylazo)-1,4-dimethyl-3-cyano-6-hydroxy-2-pyridone [2-b]

4.5 g (0.02 mol) of sodium 3-amino-6-methoxybenzenesulfonate was diazotized in a conventional manner using 1.38 g of sodium nitrile and 10 ml of hydrochloric acid. 3.28 g (0.02 mol) of 1,4-dimethyl-3-cyano-6-hydroxy-2-pyridone was dissolved in a mixture composed of 1.0 g of sodium hydroxide, 15 g of sodium acetate and 40 ml of water and then to the solution was added to the above described diazotized solution at a temperature range between 2° C. and 5° C. After stirring for 1 hour at a temperature of 5° C., the resulting yellow crystals were collected by filtration and washed with an aqueous sodium chloride solution.

The crystals was dried and chlorinated using phosphorus oxychloride in the same manner as described in 1-b to obtain 5-(3-chlorosulfonyl-4-methoxyphenylazo)-1,4-dimethyl-3-cyano-6-hydroxy-2-pyridone [2-b].

2-c: Synthesis of dye releasing redox compound (2)

4.26 g (0.01 mol) of Compound [1-a] was dissolved in a mixture composed of 20 ml of dimethylacetamide and 5 ml of pyridine and to the solution was gradually added 3.97 g (0.01 mol) of Compound [2-b] under cooling with ice. After stirring at room temperature for 30 minutes, the reaction solution was poured into cool diluted hydrochloric acid and the resulting yellow precipitate was collected by filtration and washed with water. Upon recrystallization from ethyl acetate a refined product was obtained.

3. SYNTHESIS OF DYE RELEASING REDOX COMPOUND (3)

3-b: Synthesis of 2-(5-chlorosulfonyl-2-methoxyphenylazo)-4-methoxy-1-naphthol [3-b]

4.5 g (0.2 mol) of sodium 3-amino-4-methoxybenzenesulfonate was diazotized in a conventional manner using 1.38 g of sodium nitrite. 3.48 g (0.02 mol) of 4-methoxy-1-naphthol was dissolved in 50 ml of a 15% aqueous sodium hydroxide and then to the solution was added the above described diazotized solution at a temperature range between 0° C. and 5° C. After stirring for 1 hour at a temperature of 5° C., the mixture was neutralized with hydrochloric acid and salted out with a saturated aqueous sodium chloride solution. The dark red crystals thus deposited were collected by filtration and dried.

The crystals thus obtained were chlorinated in the same manner as described in 1-b to obtain 2-(5-chlorosulfonyl-2-methoxyphenylazo)-4-methoxy-1-naphthol [3-b].

3-c: Synthesis of dye releasing redox compound (3)

4.26 g (0.01 mol) of Compound [1-a] was dissolved in a mixture composed of 20 ml of dimethylacetamide and 5 ml of pyridine and to the solution was gradually added 4.07 g (0.01 mol) of Compound [3-b] under cooling with ice. After stirring at room temperature for 20 minutes, the reaction solution was poured into cool diluted hydrochloric acid and the resulting dark red precipitate was collected by filtration. Upon recrystallization from methyl cellosolve a refined product of Compound (3) was obtained.

4. SYNTHESIS OF DYE RELEASING REDOX COMPOUND (4)

4-b: Synthesiss of 3-(3-chlorosulfonylbenzoylamino)-4-(2-methoxy-4-nitrophenylazo)-N,N-diethylaniline [4-b]

16.8 g (0.1 mol) of 2-methoxy-4-nitroaniline was diazotized using 7.0 g of sodium nitrite at a temperature range between 10° C. and 15° C.

22.7 g (0.11 mol) of 3-acetylamino-N,N-diethylaniline and 40 g of sodium acetate were dissolved in a mixture composed of 100 ml of water and 150 ml of methyl cellosolve and then to the solution was added the above described diazotized solution at a temperature range between 10° C. and 15° C. After stirring for 20 minutes at room temperature, the crystals were collected by filtration and washed with water to obtain 36 g of dark red crystals.

19.3 g of the crystals thus obtained were added to a mixture composed of 25 ml of hydrochloric acid and 70 ml of methyl cellosolve and the mixture was stirred with heating at a temperature of 100° C. for 2 hours. After cooling, the mixture was neutralized with an aqueous sodium hydroxide solution and the dark red crystals were collected by filtration and recrystallized from ethanol to obtain 14.8 g of 3-amino-4-(2-methoxy-4-nitrophenylazo)-N,N-diethylaniline.

13.8 g of the crystals thus obtained and 9.6 g of 3-chlorosulfonylbenzoyl chloride were added to 100 ml of acetonitrile and the mixture was refluxed by heating for 2 hours. After cooling, acetonitrile was removed under reduced pressure and to the residue was added cool diluted hydrochloric acid to crystallize. The crystals were collected by filtration, washed with water and dried at a temperature below 50° C. to obtain 18.5 g of 3-(3-chlorosulfonylbenzoylamino)-4-(2-methoxy-4-nitrophenylazo)-N,N-diethylaniline [4-b].

4-c: Synthesis of dye releasing redox compound (4)

4.26 g (0.01 mol) of Compound [1-a] and 5.46 g (0.01 mol) of Compound [4-b] were reacted under the same conditions as described in 1-c and the raw product thus obtained was recrystallized from methyl cellosolve to obtain Dye releasing redox compound (4).

5. SYNTHESISS OF DYE RELEASING REDOX COMPOUND (5)

5-b: Synthesis of 3-(3-chlorosulfonylbenzoylamino)-4-(3,5-dinitro-2-thienylazo)-N,N-diethylaniline [5-b]

18.9 g (0.1 mol) of 2-amino-3,5-dinitrothiophene was diazotized with nitrosylsulfuric acid prepared from 7.3 g of sodium nitrite and 50 ml of sulfuric acid at a temperature range between 20° C. and 25° C.

22.7 g (0.11 mol) of 3-acetylamino-N,N-diethylaniline and 200 g of sodium acetate were dissolved in a mixture composed of 300 ml of water and 200 ml of methyl cellosolve and then to the solution was added the above described diazotized solution at a temperature range between 10° C. and 15° C. After stirring for 20 minutes at room temperature, 300 ml of water was added to the mixture and the crystals were collected by filtration.

20.3 g of the crystals thus obtained were added to a mixture composed of 25 ml of hydrochloric acid and 70 ml of methyl cellosolve and the mixture was stirred with heating at a temperature range between 80° C. and 85° C. for 2 hours. After cooling, the mixture was neutralized with an aqueous sodium hydroxide solution and the crystals were collected by filtration and recrystallized from ethanol to obtain dark blue crystals of 3-amino-4-(3,5-dinitro-2-thienylazo)-N,N-diethylaniline.

14.6 g of the crystals thus obtained and 9.6 g of 3-chlorosulfonylbenzoyl chloride were added to 100 ml of acetonitrile and the mixture was refluxed by heating for 2 hours. After cooling, acetonitrile was removed under a reduced pressure and to the residue was added cool diluted hydrochloric acid. The dark blue precipitate were collected by filtration, washed with water and dried by air to obtain 20.8 g of 3-(3-chlorosulfonylbenzoylamino)-4-(3,5-dinitro-2-thienylazo)-N,N-diethylaniline [5-b].

Synthesis of dye releasing compound (5)

4.26 g (0.01 mol) of Compound [1-a] and 5.67 g (0.01 mol) of Compound [5-b] were reacted under the same conditions as described in 1-c and the raw product thus obtained was recrystallized from acetonitrile to obtain Dye releasing redox compound (5).

The dye releasing redox compound which releases a diffusible dye according to the present invention can be used in an amount of a certain concentration range. Generally, a suitable concentration range is from about 0.01 mol to about 4 mols of the dye releasing redox compound per mol of the organic silver salt. A particularly suitable amount in the present invention is in a concentration range of about 0.05 mols to about 1 mol per mol of the organic silver salt.

In the present invention, a reducing agent may be used, if desired. The reducing agent in this case is the so-called auxiliary developing agent, which is oxidized by the silver salt to form an oxidized product having the ability to oxidize the reducing group of R in the dye releasing redox compound.

Examples of useful auxiliary developing agents include hydroquinone, an alkyl substituted hydroquinone such as tertiary butyl hydroquinone or 2,5-dimethylhydroquinone, etc., a catechols, a pyrogallol, a halogen substituted hydroquinone such as chlorohydroquinone or dichlorohydroquinone, etc., an alkoxy substituted hydroquinones such as methoxyhydroquinone, etc., and a polyhydroxybenzene derivative such as methyl hydroxynaphthalene, etc. Further, methyl gallate, ascorbic acid, an ascorbic acid derivative, a hydroxylamine such as N,N-di-(2-ethoxyethyl)hydroxylamine, etc., a pyrazolidone such as 1-phenyl-3-pyrazolidone, 4-methyl-4-hydroxymethyl-1-phenyl-3-pyrazolidone, etc., a reductone and a hydroxy tetronic acid are also useful.

The auxiliary developing agent can be used in a certain range of concentration. Generally, a suitable concentration range is from 0.01 times by mol to 20 times by mol based on the organic silver salt, and a particularly suitable range is from 0.1 times by mol to 4 times by mol.

In the heat-developable color photographic material of the present invention, various kinds of dye releasing activators may be used. The dye releasing activator means a compound which attacks nucleophilically the dye releasing redox compound oxidized by the organic silver salt to release a diffusible dye. A base, a base releasing agent and a water releasing compound are used as a dye releasing activation. Of these dye releasing activators, the base and the base releasing agent are particularly preferred because they not only accelerate the release of the dye but they also accelerate the oxidation-reduction reaction between the organic silver salt and the dye releasing redox compound.

Examples of preferred bases are amines which include a trialkylamine, a hydroxylamine, an aliphatic polyamine, an N-alkyl substituted aromatic amine, an N-hydroxyalkyl substituted aromatic amine and a bis-[p-(dialkylamino)phenyl]methane. Further, betaine tetramethylammonium iodide and diaminobutane dihydrochloride as described in U.S. Pat. No. 2,410,644 and urea and an organic compound including an amino acid such as 6-aminocaproic acid as described in U.S. Pat. No. 3,506,444 are useful. The base releasing agent is a compound which releases a basic component by heating. Examples of typical base releasing agents are described in British Pat. No. 998,949. Preferred base releasing agents include a salt of a carboxylic acid and an organic base, and examples of suitable carboxylic acids include trichloroacetic acid and trifluoroacetic acid and examples of suitable bases include guanidine, piperidine, morpholine, p-toluidine and 2-picoline, etc. Guanidine trichloroacetate as described in U.S. Pat. No. 3,220,846 is particularly preferred. Further, an aldonic amide as described in Japanese Patent Application (OPI) No. 22625/75 are preferably used because it decomposes at high temperature to form a base.

The water releasing compound means a compound which releases water by decomposition during heat-development to convert into a compound having a vapour pressure of $10^{-5}$ Torrs or more at a temperature of 100° C. to 200° C. These compounds are known in the field of textile printing and $NH_4Fe(SO_4)_2.12H_2O$, etc. as described in Japanese Patent Application (OPI) No. 88386/75 are useful.

These dye releasing activators can be used in greatly varying amounts. It is preferable to use them in a range of 1/100 times to 10 times and, more preferably 1/20 times to 2 times by molar ratio based on silver.

Further, in the heat-developable color photographic material of the present invention, a compound which activates development and simultaneously stabilize the image can be used. Of these compounds, an isothiuronium including 2-hydroxyethylisothiuronium trichloroacetate as described in U.S. Pat. No. 3,301,678, a bisisothiuronium including 1,8-(3,6-dioxaoctane)-bis-(isothiuronium trifluoroacetate), etc. as described in U.S. Pat. No. 3,669,670, a thiol compound as described in West German Patent Application (OLS) No. 2,162,714, a thiazolium compound such as 2-amino-2-thiazolium trichloroacetate and 2-amino-5-bromoethyl-2-thiazolium trichloroacetate, etc. as described in U.S. Pat. No. 4,012,260, a compound having α-sulfonylacetate as an acid part such as bis(2-amino-2-thiazolium)-methylene-bis(sulfonylacetate), 2-amino-2-thiazolium phenylsulfonylacetate, etc. as described in U.S. Pat. No. 4,060,420, and a compound having 2-carboxycarboxyamide as an acid part as described in U.S. Pat. No. 4,088,496, and the like are preferably used.

These compounds or mixtures thereof can be used in a wide range of amounts. It is preferable to use them in a range of 1/100 times to 10 times and, particularly 1/20 times to 2 times by molar ratio based on silver.

In the heat-developable color photographic material of the present invention, a diffusion accelerator can be incorporated. The term "diffusion accelerator" means a non-hydrolizable organic compound which is solid at an ambient temperature but melts at a temperature lower than the heat treatment temperature to be used and gets into the support during the heat treatment. Examples of preferred diffusion accelerators include diphenyl, o-phenylphenol, phenol, resorcinol and pyrogallol, etc. As the diffusion accelerator, a compound which is used as a thermal solvent can be used. The term "thermal solvent" means a non-hydrolyzable organic material which is solid at an ambient temperature but melts together with other components at a temperature of heat treatment or a temperature lower than the heat treatment temperature. As the thermal solvent, a compound which becomes a solvent for the conventional developing agent and a compound having a high dielectric constant which accelerate physical development of the silver salt, etc. are useful. Preferred examples of the thermal solvents include a polyglycol as described in U.S. Pat. No. 3,347,675, for example, polyethylene glycol having an average molecular weight of 1,500 to 20,000, a derivative of polyethylene oxide such as an oleic acid ester, thereof, etc., beeswax, monostearin, a compound having a high dielectric constant which has a —$SO_2$— or —CO— group such as acetamide, succinimide, ethylcarbamate, urea, methylsulfonamide, ethylene carbonate, a polar substance as described in U.S. Pat. No. 3,667,959, lactone of 4-hydroxybutanoic acid, methylsulfinylmethane, tetrahydrothiophene-1,1-dioxide, and 1,10-decanediol, methyl anisate, biphenyl suberate, etc. as described in *Research Disclosure,* pages 26 to 28 (December 1976), etc.

The light-sensitive silver halide and the organic silver salt used in the present invention are prepared in the binder as described below. Further, the dye releasing redox compound is dispersed in the binder described below.

The binder which can be used in the present invention can be employed individually or in a combination of two or more. Both of a hydrophilic polymer and a hydrophobic polymer can be used as the binder according to the present invention. The typical hydrophilic binder is a transparent or translucent hydrophilic colloid, examples of which include a natural substance for example, protein such as gelatin, a gelatin derivative, a cellulose derivative, a polysaccharide such as starch, gum arabic, etc. and a synthetic polymer, for example, a water-soluble polyvinyl compound such as polyvinylpyrrolidone, acrylamide polymer, etc. Another example of the synthetic polymer compound is a dispersed vinyl compound in a latex form which is used for the purpose of increasing the dimensional stability of a photographic material.

The hydrophobic polymer binder which can be used in the present invention is a transparent synthetic polymer, examples of which include those described in U.S. Pat. Nos. 3,142,586, 3,193,386, 3,062,674, 3,220,844, 3,287,289 and 3,411,911. Examples of the effective polymers include a water insoluble polymer composed of a monomer such as an alkyl acrylate, an alkyl methacrylate, acrylic acid, a sulfoalkyl acrylate or a sulfoalkyl methacrylate, etc. and a polymer having cyclic sulfobetaine unit as described in Canadian Pat. No. 774,054. Examples of preferred polymers include polyvinyl butyral, polyacrylamide, cellulose acetate butyrate, cellulose acetate propionate, polymethyl methacrylate, polyvinyl pyrrolidone, polystyrene, ethyl cellulose, polyvinyl chloride, chlorinated rubber, polyisobutylene, a butadiene-styrene copolymer, a vinyl chloridevinyl acetate copolymer, a vinyl chloridevinyl acetatemaleic acid copolymer, polyvinyl alcohol, polyvinyl acetate, benzyl cellulose, acetyl cellulose, cellulose propionate and cellulose acetate phthalate, etc. Among these polymers, polyvinyl butyral, polyvinyl acetate, ethyl cellulose, polymethyl methacrylate and cellulose acetate butyrate are particularly preferred to use. If necessary, two or more of them may be used as a mixture. The amount of the polymer binder is in a range of from about 1/10 to 10 times and, preferably, ¼ to 4 times by weight ratio based on the organic silver salt.

The support capable of receiving a dye or the layer composed of an organic high molecular weight compound capable of receiving a dye on the support used in the present invention should be able to uphold the photographic light-sensitive layer and simultaneously receive the dye released from the dye releasing redox compound during the heat development procedure. The support or the organic high molecular weight compound described above which is suitable for there purposes is composed of a heat-resisting organic high molecular weight compound having a glass transition temperature of from 40° C. to 250° C. which is used in a form of a film or a resin plate. The mechanism by which the dye released from the dye releasing redox compound gets into the support is not entirely clear. However, it is generally believed that the heat kinetics of a polymer chain become increased at a treatment temperature above the glass transition temperature and the dye can get into a gap thus-formed in the molecular chain. Therefore, the dye is distinguished from the dye releasing redox compound and only dye can get into the support to form a clear image by the use of the support composed of an organic high molecular weight compound having a glass transition temperature of from 40° C. to 250° C.

Preferred examples of the organic high molecular weight compounds used in the present invention include polystyrene having a molecular weight of 2,000 to 85,000, a polystyrene derivative having a substituent containing not more than 4 carbon atoms, polyvinyl cyclohexane, polydivinyl benzene, polyvinyl pyrrolidone, polyvinyl carbazole, polyallyl benzene, polyvinyl alcohol, a polyacetal such as polyvinyl formal, polyvinyl butyral, etc., polyvinyl chloride, chlorinated polyethylene, polytrichlorofluoroethylene, polyacrylonitrile, poly-N,N-dimethyl allylamide, a polyacrylate having a p-cyanophenyl group, a pentachlorophenyl group and a 2,4-dichlorophenyl group, polyacryl chloroacrylate, polymethyl metacrylate, polyethyl methacrylate, polypropyl methacrylate, polyisopropyl methacrylate, polyisobutyl methacrylate, polytertiary butyl methacrylate, polycyclohexyl methacrylate, polyethyleneglycol dimethacrylate, poly-2-cyanoethyl methacrylate, a polyester such as polyethylene terephthalate, etc., polysulfone, bisphenol A polycarbonate, a polycarbonate, polyanhydride, a polyamide, a cellulose acetate. Further, synthetic polymers having a glass transition temperature of from 40° C. to 250° C. as described in J. Brandrup and E. H. Immergut, *Polymer Handbook,* 2nd Edition (John Wiley & Sons) are useful. These high molecule weight compounds can be used individually or as a copolymer composed of a combination of two or more thereof.

Examples of particularly preferred supports include a cellulose acetate film such as cellulose triacetate, cellulose diacetate, etc., a polyamide film such as a combination of heptamethylenediamine and terephthalic acid, a combination of fluorenedipropylamine and adipic acid, a combination of hexamethylenediamine and diphenic acid, a combination of hexamethylenediamine and isophthalic acid, etc., a polyester film such as a combination of diethylenglycol and diphenylcarboxylic acid, a combination of bis-p-carboxy-phenoxy butane and ethyleneglycol, etc., a polyethylene terephthalate film and a polycarbonate film. These films may be modified. For example, a polyethylene terephthalate film modified using cyclohexanedimethanol, isophthalic acid, methoxypolyethyleneglycol, 1,2-dicarbomethoxy-4-benzenesulfonic acid, etc. as a modifying agent is effectively used.

The support can be composed of a single layer or two or more layers. Further, the support may contain titanium dioxide or have thereon a portion or a layer containing titanium dioxide to form a white reflective layer. Moreover, the support according to the present invention may be glass, paper, metal, etc. having coated thereon a layer composed of the above described organic high molecular weight compound.

In the present invention, though it is not so necessary to further incorporate a substance or a dye for preventing irradiation or halation in the photographic material, since the dye releasing redox compound is colored, it is possible to add a filter dye or a light absorbing material as described in Japanese Patent Publication No. 3692/73, U.S. Pat. Nos. 3,253,921, 2,527,583 and 2,956,879, etc. in order to further improve sharpness. Preferably, these dyes have a thermally bleaching property. For example, dyes as described in U.S. Pat. Nos. 3,769,019, 3,745,009 and 3,615,432 are preferred.

The photographic material according to the present invention may contain, if desired, various additives known for the heat-developable photographic material and may have an antistatic layer, an electrically conductive layer, an protective layer, an intermediate layer, an anti-halation layer and a strippable layer, etc., in addition to the light-sensitive layer. As the additives, those described in *Research Disclosure,* Vol. 170, No. 17029, June 1978, for example, a plasticizer, a dye for improving sharpness, an anti-halation dye, a sensitizing dye, a matting agent, a surface active agent. a fluorescent whitening agent, a fading preventing agent, etc. may be used.

The protective layer, the intermediate layer, the subbing layer, the back layer and other layers can be produced by preparing each coating solution and applying in order to the support by various coating methods such as a dip coating method, an air-knife coating method, a curtain coating method, a hopper coating method as described in U.S. Pat. No. 3,681,294 and drying to prepare the light-sensitive material, in a manner similar to the heat-developable light-sensitive layer according to the present invention. If desired, two or more layers may be applied at the same time by the method as described in U.S. Pat. No. 2,761,791 and British Pat. No. 837,095.

For the heat-developable photographic material of the present invention, various means for exposing to light can be used. A latent image is obtained by imagewise exposure to radiant rays including visible rays. Generally, a light source used for conventional color prints can be used, examples of which include a tungsten lamp, a mercury lamp, a halogen lamp such as an iodine lamp, etc., a xenon lamp, a laser light source, a CRT (cathode ray tube) light source, a fluorescent tube, a light-emitting diode, etc.

As the original, not only a line drawing but also a photograph having gradation may be used. It is also possible to take a photograph of a portrait or landscape by means of a camera. Printing from the original may be carried out by contact printing and superimposing the original on the photographic material or may be carried out by reflection printing or enlargement printing.

Further, it is possible to carry out the printing of an image photographed by a videocamera or image information sent from a television broadcasting station by displaying directly on CRT or FOT (fiber optical tube) and focusing the resulting image on the heat-developable photographic material by contacting therewith or by means of a lens.

Recently, LED (light-emitting diode) which has been greatly improved is utilized as an exposure means or display means for various apparatus and devices. It is difficult to produce LED which effectively emits blue light. Therefore, in order to reproduce the color image, three kinds of LED consisting of those emitting each green light, red light, and infrared light are used. The light-sensitive layers to be sensitized so that these lights are produced so as to release a yellow dye, a magenta dye and a cyan dye, respectively. The photographic material is constructed such that the green-sensitive part (layer) contains a yellow dye releasing redox compound, the red-sensitive part (layer) contains a magenta dye releasing redox compound and the infrared-sensitive part (layer) contains a cyan dye releasing redox compound. Other combinations can be utilized, if desired.

In addition to the above described methods for contact exposure or projection of the original, there can be used a method of exposure wherein the original illuminated by a light source is stored in a memory of a leading computer by means of a light-receiving element such as a phototube or CCD (charge coupling device), etc., the information is, if desired, subjected to processing, the so-called image treatment, and the resulting image information is reproduced on CRT to utilize it as an imagelike light source or three kinds of LED are emitted according to the processed information.

After the heat-developable color photographic material is exposed to light, the latent image thus obtained can be developed by heating the whole material at a suitably elevated temperature, for example, from about 80° C. to about 250° C. for from about 0.5 seconds to about 120 seconds. Any higher temperature on lower temperature can be utilized by prolonging or shortening the heating time within the above described range. Particularly, a temperature range from about 110° C. to about 160° C. is useful. As a heating means, a simple heat plate, an iron, a heat roller or analogues thereof may be used.

According to the present invention, a color image is composed of dyes diffused into a support. Therefore, a visible image can be obtained by (1) peeling apart the emulsion layer from the support after heat development or (2) providing a white reflective layer containing titanium dioxide dispersed therein between the support and the emulsion layer. In order to peel apart the emulsion layer, various methods can be employed. For example, the emulsion layer can be mechanically peeled apart using an adhesive tape. Alternatively, it can be removed by dissolving it with a solvent such as ethyl alcohol. Further, a method in which a stripping layer is provided between the emulsion layer and the support is effectively used. The stripping layer is composed of an organic material which has a low affinity to either a binder of the emulsion layer or a synthetic polymer composed of the support or both of them.

The present invention will be explained in greater detail with reference to the following examples, but the present invention should not be construed as being limited thereto.

EXAMPLE 1

A silver benzotriazole emulsion containing light-sensitive silver bromide was prepared in the following manner.

| | | |
|---|---|---|
| (A) | Benzotriazole | 12 g |
| | Isopropyl alcohol | 200 ml |
| (B) | $AgNO_3$ | 17 g |
| | $H_2O$ | 50 ml |
| (C) | LiBr | 2.1 g |
| | Ethanol | 20 ml |

Solution B was added to Solution A with stirring at 40° C. Solution A became turbid and silver salts of benzotriazole were formed.

To the resulting solution, Solution C was added, by which silver was supplied from the silver benzotriazole to convert part of the silver benzotriazole into silver bromide.

The resulting powdery crystals were collected by filtration and they were added to a polymer solution prepared by dissolving 20 g of polyvinyl butyral in 200 ml of isopropyl alcohol, followed by dispersing for 30 minutes by a homogenizer.

To 10 g of the above described silver benzotriazole emulsion containing light-sensitive silver bromide was added a solution prepared by dissolving 0.40 g of Dye releasing redox compound (9) having the following formula:

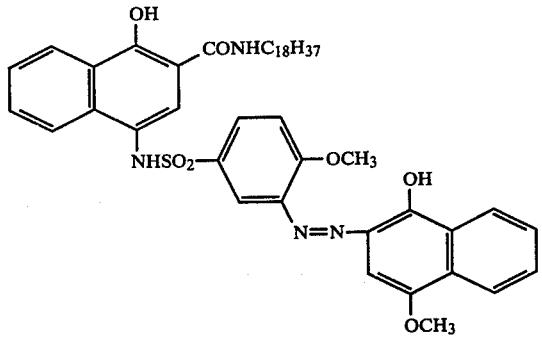

and 0.22 g of guanidine trichloroacetate in a mixture of 4 ml of ethyl alcohol and 2 ml of N,N-dimethylformamide and stirred. The resulting mixture was applied to a polyethylene terephthalate film having a thickness of 180 μm at a wet film thickness of 100 μm. After the resulting photographic material was dried, it was imagewise exposed at 2,000 luxes for 10 seconds using a tungsten lamp. This imagewise exposed sample was uniformly heated for 60 seconds on a heat block heated at 160° C. After the sample was cooled to room temperature, the coated emulsion layer was mechanically peeled apart from the polyethylene terephthalate film using an adhesive tape. A clear magenta transferred negative image was obtained on the polyethylene terephthalate film. When the density of the magenta negative image was measured by a Macbeth transmission densitometer (TD-504), the maximum density to green light was 1.30 and the minimum density was 0.18. Further, the gradation of the sensitometric curve was a density difference of 0.65 to an exposure difference of 10 times in the straight line part.

EXAMPLE 2

The same procedure as described in Example 1 was carried out except using a polyethylene terephthalate film having a layer of diacetyl cellulose coated thereon at a dry thickness of 1 μm as a support. The emulsion layer was mechanically peeled apart from the polyethylene terephthalate film and a clean magenta negative image having the maximum density of 1.24 and the minimum density of 0.08 was obtained when the transmission density to green light was measured.

EXAMPLE 3

A polyethylene terephthalate film having a white layer containing titanium dioxide on one surface thereof was used as a support. The procedure as described in Example 1 was repeated except coating the emulsion layer on the opposite surface of the support to the white layer. As a result of peeling apart the emulsion layer, a clear magenta reflective image was obtained in the polyethylene terephthalate film.

EXAMPLE 4

The same procedure as described in Example 1 was repeated except for using the dye releasing redox compound as shown in Table 1 below in place of Dye releasing redox compound (9) used in Example 1. The results obtained are shown in Table 1 below.

TABLE 1

| Dye Releasing Redox Compound | Amount Added (g) | Color Hue | Maximum Density |
|---|---|---|---|
| (1) | 0.30 | Yellow | 1.0 |
| (8) | 0.50 | " | 0.65 |
| (3) | 0.35 | Magenta | 1.10 |
| (10) | 0.60 | " | 1.65 |
| (5) | 0.35 | Cyan | 1.50 |
| (12) | 0.60 | " | 1.60 |

From the result shown in Table 1, it can be seen that the dye diffused to the support in an amount sufficient to form a color image.

EXAMPLE 5

In place of the silver benzotriazole emulsion containing light-sensitive silver bromide used in Example 1, a silver behenate emulsion containing light-sensitive silver bromide was used.

The silver behenate emulsion containing light-sensitive silver bromide was prepared in the following manner. 340 g of behenic acid was added to 500 ml of water and dissolved by heating to 85° C. with stirring. To the resulting solution, an aqueous solution containing 20 g of sodium hydroxide dissolved in 500 ml of water was added at a rate of 100 ml per minute.

The solution was cooled to 30° C., and a solution prepared by dissolving 85 g of silver nitrate in 500 ml of water was added to the above described solution at a rate of 100 ml per minute. The mixture was stirred at 30° C. for 90 minutes.

To the resulting solution, a solution prepared by dissolving 40 g of polyvinyl butyral in a mixture of 500 ml of butyl acetate and 500 ml of isopropyl alcohol was added, and the mixture was allowed to stand. Then, the liquid phase was removed, and the solid phase was subjected to centrifugal separation (at 3,000 rpm for 30 minutes).

To the solid phase, 400 ml of isopropyl alcohol was added. The mixture was stirred for 10 minutes, and thereafter it was mixed with a solution prepared by dissolving 270 g of polyvinyl butyral in 800 ml of isopropyl alcohol, and the mixture was dispersed at 8,000 rpm for 30 minutes by a homogenizer. While maintaining the resulting solution at 50° C., 160 ml of an acetone solution containing 4.2% by weight of N-bromosuccinimide was added thereto and the mixture was reacted for 60 minutes, by which silver bromide was formed on a part of silver behenate.

A photographic material was prepared by the same procedure as described in Example 1, except for the use of 10 g of the above described silver behenate emulsion containing light-sensitive silver bromide. Furthermore, the same operation as described in Example 1 was carried out. As a result, a transferred magenta negative image was obtained in the polyethylene terephthalate film. The magenta negative image has the maximum density of 0.80 as a transmission density to green light and the minimum density of 0.35.

EXAMPLE 6

The same procedure as described in Example 1 was repeated except for the further addition of 0.5 g of ophenylphenol as a diffusion accelerator. A transferred magenta image having the maximum density of 1.80 as a density to green light and the minimum density of 0.38 was obtained in the polyethylene terphthalate film.

EXAMPLE 7

6.5 g of benzotriazole and 10 g of gelatin were dissolved in 1000 ml of water. The solution was stirred while maintaining it at 50° C. and to which was added a solution containing 8.5 g of silver nitrate dissolved in 100 ml of water for 2 minutes. Then, a solution containing 1.2 g of potassium bromide dissolved in 50 ml of water was added to the above described solution for 2 minutes. The resulting emulsion was precipitated by controlling the pH to remove excess salt. The pH of the emulsion was adjusted to 6.0. The yield was 200 g.

A dispersion of a dye releasing redox compound in gelatin was prepared in the following manner.

15 g of Dye releasing redox compound A and 0.5 g of sodium 2-ethylhexylsulfosuccinate as a surface active agent were dissolved in 20 ml of ethyl acetate and 4 ml of N,N-dimethylformamide. The solution was mixed with 100 g of a 10% aqueous gelatin solution with stirring and dispersed at 10,000 rpm for 10 minutes using a homogenizer. The resulting dispersion was designated a dispersion of a dye releasing redox compound.

A coating mixture was prepared in the following manner.

| | |
|---|---|
| (a) Silver benzotriazole emulsion containing light-sensitive silver bromide | 10 g |
| (b) Dispersion of dye releasing redox compound | 3 g |
| (c) 5% by weight methanol solution of guanidine trichloroacetate | 2 ml |

The above described components (a), (b) and (c) were mixed with stirring and coated on a polyethylene terephthalate film having a thickness of 180 μm at a wet film thickness of 100 μm. After drying, the resulting sample was imagewise exposed at 2,000 luxes for 10 seconds using a tungsten lamp. The sample was then uniformly heated on a heat block heated at 160° C. for 60 seconds. After the sample was cooled to room temperature, the emulsion layer was removed to obtain a transferred magenta negative image on the polyethylene terephthalate film. The transferred image had the maximum density of 1.25 and the minimum density of 0.30 to green light.

EXAMPLE 8

The same procedure as described in Example 1 was repeated except that the support shown in Table 2 below was used in place of the support used in Example 1. The results thus obtained are shown in Table 2 below.

TABLE 2

| Support | Heat Treatment Temperature (°C.) | Time (min.) | Maximum Density | Minimum Density |
|---|---|---|---|---|
| 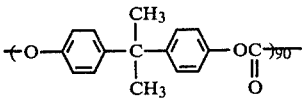 | 160 | 2 | 1.45 | 0.20 |
| 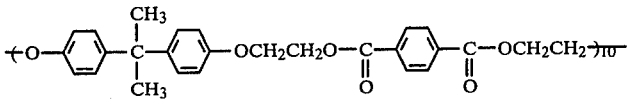 | | | | |
| Cellulose triacetate | 140 | 2 | 1.10 | 0.30 |
| Cellulose diacetate | 140 | 2 | 1.15 | 0.38 |
| Polyester(bis-carboxyphenoxybutane and ethyleneglycol) | 160 | 2 | 1.55 | 0.25 |
| Polyamide(bis(3-aminopropyl)ether and heptamethylenediamine) | 140 | 2 | 1.38 | 0.20 |
| Polystyrene (μW: 10,000) | 160 | 2 | 0.56 | 0.05 |

From the result shown in Table 2, it can be seen that the dye diffused to the support in an amount sufficient to form a color image.

While the invention has been described in detail and with reference to specific embodiment thereof, it will be apparent to one skilled in the art that various changes and modifications can be made therein without departing from the spirit and scope thereof.

What is claimed is:

1. A heat developable color photographic material, comprising:
   - a support having a surface;
   - a light-sensitive layer on the surface, the layer being comprised of:
   - a light-sensitive silver halide;
   - an organic silver salt;
   - a binder;
   - a dye releasing redox compound which is immobilized in said binder, and which releases a diffusible dye represented by the general formula:

$$R—SO_2—D \quad (I)$$

wherein R represents a reducing group capable of being oxidized by the organic silver salt; and D represents a dye portion for forming an image which does not contain a carboxylic acid group or a sulfonic acid group; and wherein the support is characterized by its ability to receive a released dye.

2. A heat-developable color photographic material, comprising
   - a support having a surface;
   - a first layer on the surface comprised of an organic high molecular weight compound which characterized by its ability to receive a released dye;
   - a light-sensitive layer on the first layer, the light sensitive layer comprising:
   - a light-sensitive silver halide;
   - an organic silver salt compound;
   - a binder;
   - a dye releasing activator; and
   - a dye releasing redox compound which is immobilized in said binder, and which released a diffusible dye, wherein the dye releasing redox compound is represented by the following formula:

$$R—SO_2—D \quad (I)$$

wherein R represents a reducing group capable of being oxidized by the organic silver salt; and D represents a dye portion for forming an image which does not contain a carboxylic acid group or a sulfonic acid group.

3. A heat-developable color photographic material as claimed in claim 1 or 2, wherein the reducing group represented by R has an oxidation reduction potential to a saturated calomel electrode of 1.2 V or less.

4. A heat-developable color photographic material as claimed in claim 1 or 2, wherein the reducing group represented by R is represented by the following general formuae (II) to (IX):

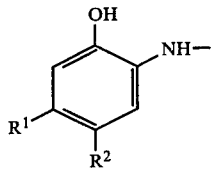

(II)

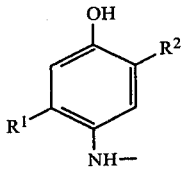

(III)

-continued (IV)

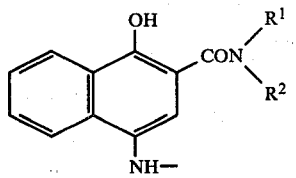

(V)

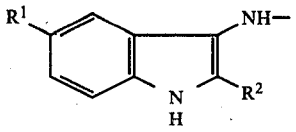

(VI)

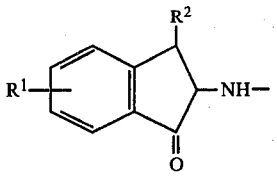

(VII)

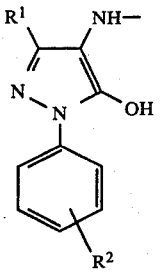

(VIII)

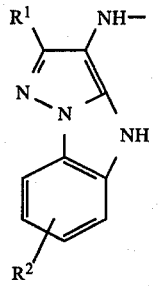

(IX)

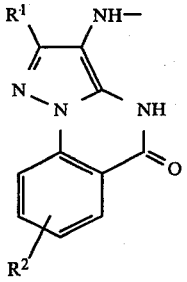

wherein $R^1$ and $R^2$, which may be the same or different, each represents hydrogen or a substituent selected from the group consisting of an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group and an N-substituted sulfamoyl group, and these substituents may be further substituted with a hydroxyl group, a carboxyl group, a sulfo group, a cyano group, a sulfamoyl group, a carbamoyl group, an acylamino group, an alkylsulfonylamino group, an arylsulfonylamino group, a ureido group or a substituted ureido group.

5. A heat-developable color photographic material as claimed in claim 4, wherein the total number of the carbon atoms of substituents represented by $R^1$ and $R^2$ is from 4 to 15.

6. A heat-developable color photographic material as claimed in claim 1 or 2, wherein the dye portion represented by D includes an azo dye, an azomethine dye, an anthraquinone dye, a naphthoquinone dye, a styryl, a quinophthalone dye or a phthalocyanine dye.

7. A heat-developable color photographic material as claimed in claim 6, wherein the dye portion represented by D includes a water insoluble dye

8. A heat-developable color photographic material as claimed in claim 6, wherein the dye included in the dye portion represented by D is represented by the following general formula:

Yellow:

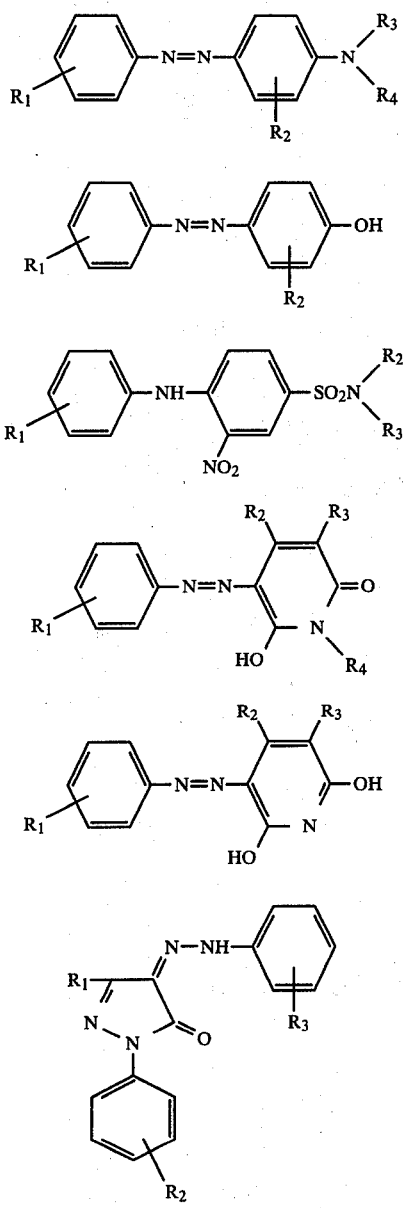

-continued
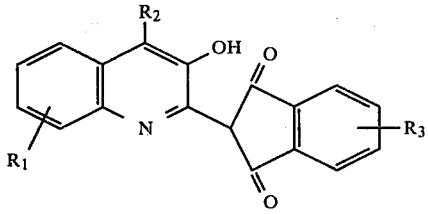
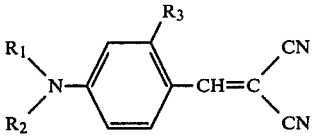
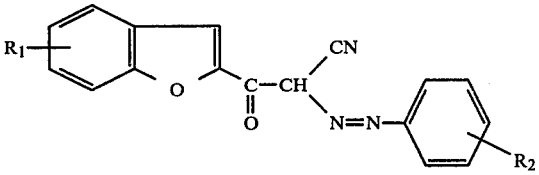
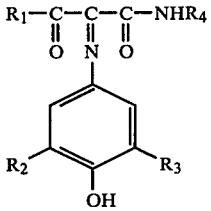
Magenta:
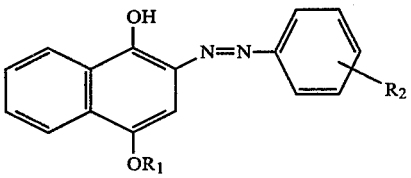
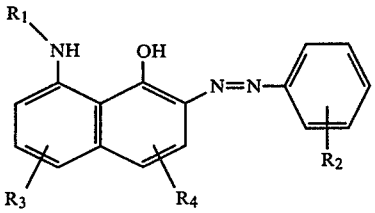
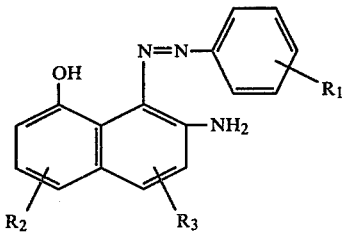
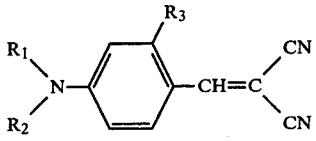
-continued
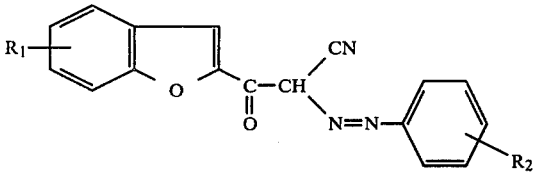
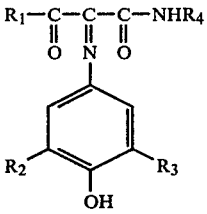
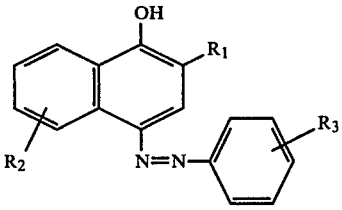
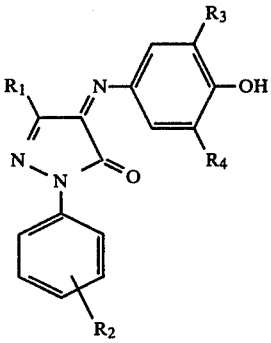
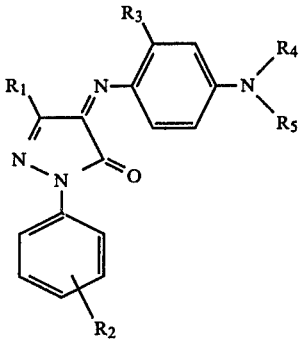
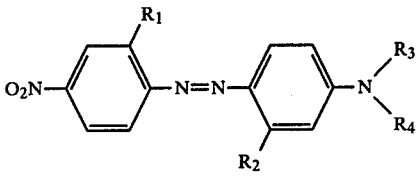
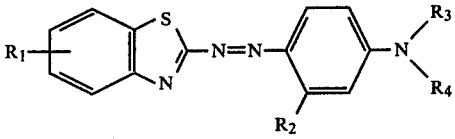

-continued
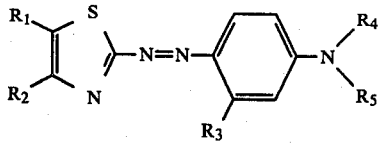
Cyan:
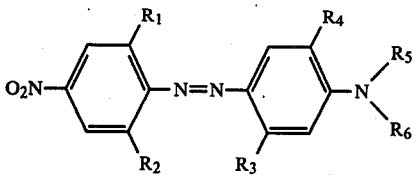
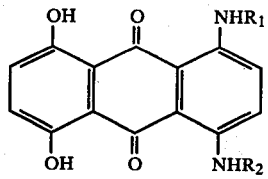
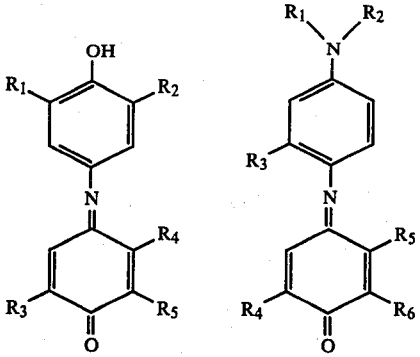
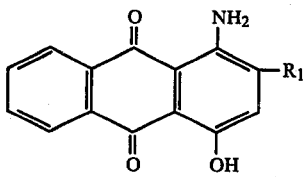
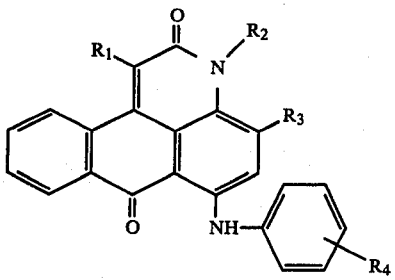
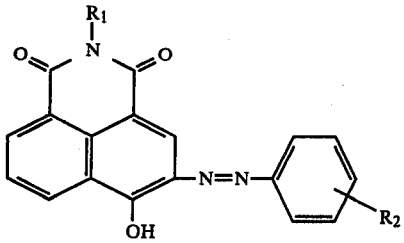
-continued
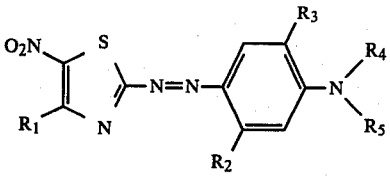
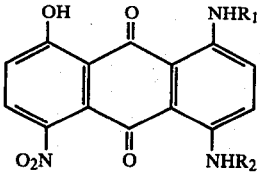
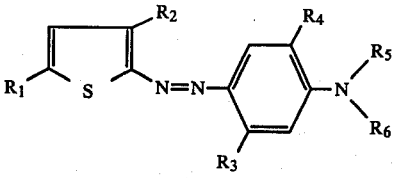
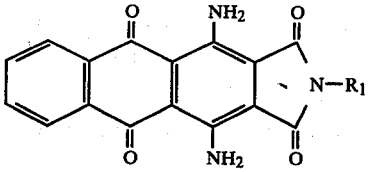
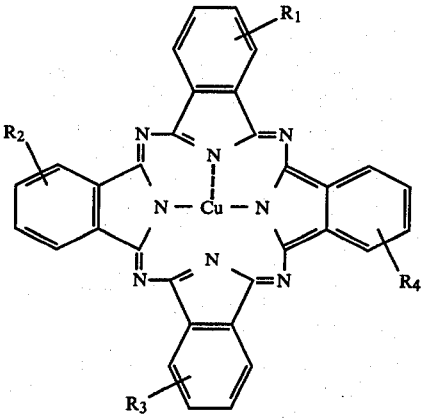
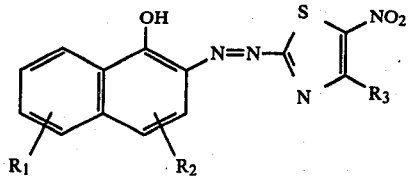
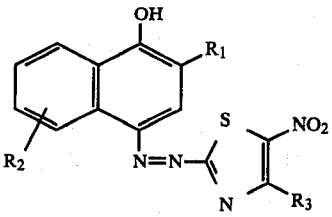

-continued

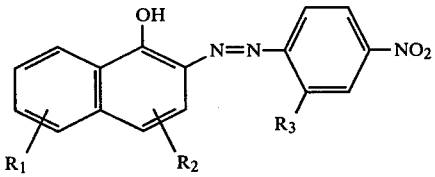

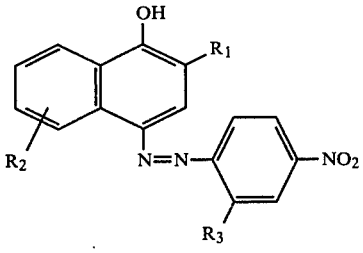

wherein $R_1$ to $R_6$, which may be the same or different, each represents hydrogen or a substituent selected from the group consisting of an alkyl group, a cycloalkyl group, an aralkyl group, an alkoxy group, an aryloxy group, an aryl group, an acylamino group, an acyl group, an cyano group, a hydroxy group, an alkylsulfonylamino group, an arylsulfonylamino group, an alkylsulfonyl group, a hydroxyalkyl group.

9. A heat-developable color photographic material as claimed in claim 8, the number of the carbon atoms of substituent represented by $R_1$ to $R_6$ is from 1 to 8 and the total number of the carbon atoms of substituents represented by $R_1$ to $R_6$ is from 1 to 18.

10. A heat-developable color photographic material as claimed in claim 9, wherein the substituents of $R_1$ to $R_6$ each represents hydrogen.

11. A heat-developable color photographic material as claimed in claim 1 or 2, wherein the light-sensitive silver halide is silver chloride, silver chlorobromide, silver chloroiodide, silver bromide, silver iodobromide, silver chloroiodobromide or silver iodide.

12. A heat-developable color photographic material as claimed in claim 1 or 2, wherein the light-sensitive silver halide is present in a range from 0.005 mols to 5 mols per mol of the organic silver salt.

13. A heat-developable color photographic material as claimed in claim 1 or 2, wherein the particle size of the silver halide is from 0.001 μm to 2 μm.

14. A heat-developable color photographic material as claimed in claim 1 or 2, wherein the organic silver salt is a silver salt which forms silver by reacting with the dye releasing redox compound, when it is heated to a temperature of above 80° C. in the presence of exposed silver halide.

15. A heat-developable color photographic material as claimed in claim 1 or 2, wherein the organic silver salt is a silver salt of an organic compound having a carboxy group, a silver salt of a compound containing a mercapto group or a thione group or a silver salt of a compound containing an imino group.

16. A heat-developable color photographic material as claimed in claim 15, wherein the organic silver salt is a silver salt of carboxylic acid derivatives or N-containing heterocyclic compounds.

17. A heat-developable color photographic material as claimed in claim 1 or 2, wherein the light-sensitive silver halide and the organic silver salt are present in the same layer.

18. A heat-developable color photographic material as claimed in claim 1 or 2, wherein an amount of the dye releasing redox compound is from 0.01 mol to 4 mol per mol of the organic silver salt.

19. A heat-developable color photographic material as claimed in claim 1 or 2, wherein the color photographic material further contains an auxiliary developing agent.

20. A heat-developable color photographic material as claimed in claim 1 or 2, wherein the dye releasing activator is a base, a base releasing agent or a water releasing compound.

21. A heat-developable color photographic material as claimed in claim 1 or 2, wherein the color photographic material further contains a diffusion accelerator.

22. A heat-developable color photographic material as claimed in claim 1 or 2, wherein the color light-sensitive material further contains a thermal solvent.

23. A heat-developable color photographic material as claimed in claim 1 or 2, wherein the binder is a hydrophilic polymer.

24. A heat-developable color photographic material as claimed in claim 1 or 2, wherein the binder is a hydrophobic polymer.

25. A heat-developable color photographic material as claimed in claim 1, wherein the support capable of receiving a released dye is composed of an organic high molecular weight compound having a glass transition temperature of from 40° C. to 250° C.

26. A heat-developable color photographic material as claimed in claim 2, wherein the organic high molecular weight compound in the layer has a glass transition temperature of from 40° C. to 250° C.

* * * * *